US007815277B2

(12) United States Patent
Yamada

(10) Patent No.: US 7,815,277 B2
(45) Date of Patent: Oct. 19, 2010

(54) IMAGE RECORDING DEVICE

(75) Inventor: Takahisa Yamada, Hachioji (JP)

(73) Assignee: Olympus Corporation, Tokyo (JP)

( * ) Notice: Subject to any disclaimer, the term of this patent is extended or adjusted under 35 U.S.C. 154(b) by 96 days.

(21) Appl. No.: 12/352,072

(22) Filed: Jan. 12, 2009

(65) Prior Publication Data

US 2009/0179937 A1 Jul. 16, 2009

(30) Foreign Application Priority Data

Jan. 15, 2008 (JP) ..... 2008-005431

(51) Int. Cl.
*B41J 29/38* (2006.01)

(52) U.S. Cl. ..... 347/17; 347/18

(58) Field of Classification Search ..... 347/17, 347/18

See application file for complete search history.

(56) References Cited

U.S. PATENT DOCUMENTS

2006/0152541 A1* 7/2006 Isozaki et al. ..... 347/17

2006/0284914 A1* 12/2006 Murakami et al. ..... 347/17

FOREIGN PATENT DOCUMENTS

JP 2003-127417 A 5/2003

JP 2005-231367 A 9/2005

* cited by examiner

*Primary Examiner*—Matthew Luu
*Assistant Examiner*—Brian J Goldberg
(74) *Attorney, Agent, or Firm*—Holtz, Holtz, Goodman & Chick, PC

(57) ABSTRACT

An image recording device include a control section. The control section circulates the ink in the ink path by section of a circulation driving section, sets at least one of the heads selected based on a temperature of the heads as a temperature measurement head, and controls the temperature of the ink based on an output value from a corresponding one of the temperature sensors provided in the temperature measurement head.

21 Claims, 19 Drawing Sheets

IMAGE RECORDING DEVICE

CROSS-REFERENCE TO RELATED APPLICATIONS

This application is based upon and claims the benefit of priority from prior Japanese Patent Application No. 2008-005431, filed Jan. 15, 2008, the entire contents of which are incorporated herein by reference.

BACKGROUND OF THE INVENTION

1. Field of the Invention

The present invention relates to an image recording device which ejects ink from a recording head comprising an ink supply system which circulates the ink and records an image on a recording medium.

2. Description of the Related Art

In general, in order that an image recording device such as an ink-jet printer ejects the optimum amount of ink from a recording head, the viscosity of ink, which changes according to temperature, needs to be kept within a preferable range. Therefore, the ink supplied to the recording head is controlled to a preferable temperature in advance by providing a temperature sensor and a heating mechanism in an ink system channel. For example, Jpn. Pat. Appln. KOKAI Publication No. 2003-127417 discloses providing a temperature sensor in each of a subtank, an ink flow path, and a recording head, and controlling a heating mechanism based on temperature information detected by one of the temperature sensors to adjust the temperature of the ink.

Further, Jpn. Pat. Appln. KOKAI Publication No. 2005-231367 discloses an ink-jet printer which circulates ink between a print head and a subtank, detects the temperature of ink in the subtank and a recording head, and controls the temperature of the ink within a predetermined range. In this kind of temperature control, since the temperature of an ink flow path is controlled using a temperature sensor provided in a recording head, it must be noted that the temperature of the recording head may increase by driving and may deviate from the temperature of the ink in the overall ink path.

BRIEF SUMMARY OF THE INVENTION

The present invention provides an image recording device which controls the temperature of an ink path using a temperature sensor provided in a recording head such that the temperature of the ink becomes optimum, by decreasing an effect of heat caused by driving of the recording head itself, and detecting the temperature of the ink.

According to an embodiment of the present invention, there is provided an image recording device comprising a head group formed of a plurality of heads which eject ink drops from a plurality of nozzle holes, a tank configured to store ink which is supplied to the heads, an ink path which connects the tank with the heads and in which the ink is circulated by a circulation driving means, a temperature sensor provided in each of the heads, a head driving means for applying a driving signal to eject ink drops to the heads, a control means for controlling the circulation driving means and the head driving means, a printing mode in which a printing instruction is accepted, and a waiting mode which is other than the printing mode. The control means circulates the ink in the ink path by means of a circulation driving means, sets at least one of the heads selected based on a temperature of the heads as a temperature measurement head, and controls the temperature of the ink based on an output value from a corresponding one of the temperature sensors provided in the temperature measurement head.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF INVENTION

Hereinafter, an embodiment of the present invention will now be described in detail with reference to the accompanying drawings.

Figure 1:
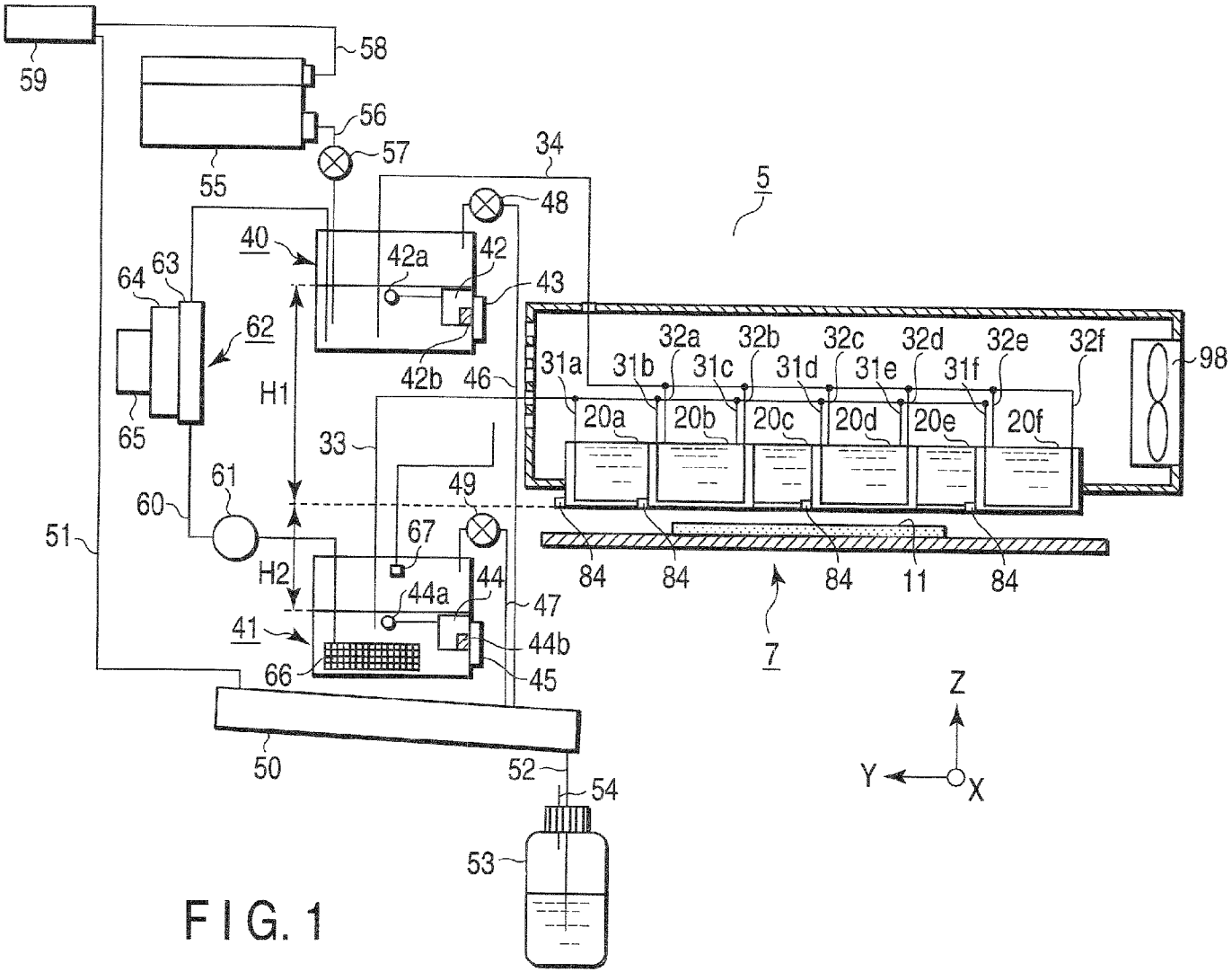
FIG. 1 illustrates an ink flow path of an image recording device according to the present embodiment.
Figure 2:
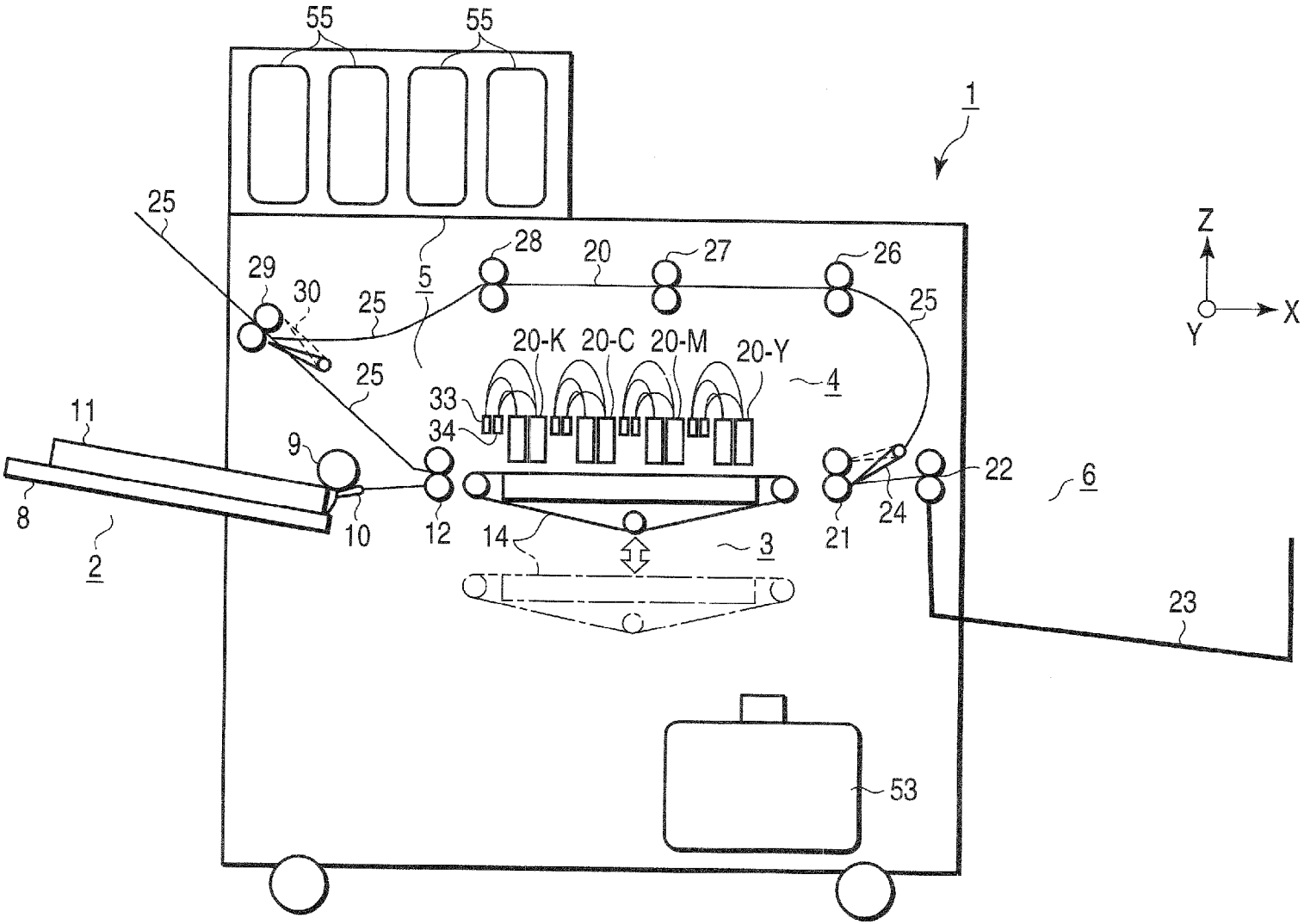
FIG. 2 shows an overall general concept of the image recording device.

FIG. 1 illustrates an ink flow route of an image recording device of the present embodiment, and FIG. 2 shows the general concept of the image recording device. In the accompanying drawings, the direction in which a recording medium is conveyed in the image recording device is shown as an x-axis direction or a vertical scanning direction, and the direction crossing the direction in which the recording medium is conveyed is shown as a y-axis direction, a main scanning direction, or a width direction of the recording medium. Further, the direction crossing the x-axis and the y-axis is shown as a z-axis direction or an up/down direction.

The overall configuration of the image recording device of the present embodiment will be described with reference to FIG. 2. An image recording device 1 is mainly formed of a recording medium supplier unit 2, a recording medium conveyor unit 3, an image formation unit 4, an ink supplier unit 5, and a recording medium container 6.

The recording medium supplier unit 2 is formed of a feed tray 8, a feed roller 9, and a separation pad 10. The feed tray 8 is charged with a plurality of recording mediums 11. Tips of the recording mediums 11 are pressed against the feed roller 9 by means of an urging mechanism, not shown. Further, the feed roller 9 is provided with the separation pad 10 for separating the recording mediums 11 one by one and carrying them into the device.

While the feed roller 9 rotates in the direction in which the mediums are conveyed, the separation pad 10 acts to put a break on the recording mediums which are being conveyed. Further, a pair of resist rollers 12 is provided in a downstream direction in the direction in which the medium is conveyed.

The pair of resist rollers 12 repeats rotation and stop by means of a driving mechanism, not shown, and align the tips of the recording mediums 11 against a nip of the pair of resist rollers 12. Immediately after that, the recording mediums 11 are aligned by restarting the rotation driving, and the recording mediums 11 are transmitted to the recording medium conveyor unit 3 (a belt conveyor unit 14) by providing timing with supplied image recording information.

Figure 3:
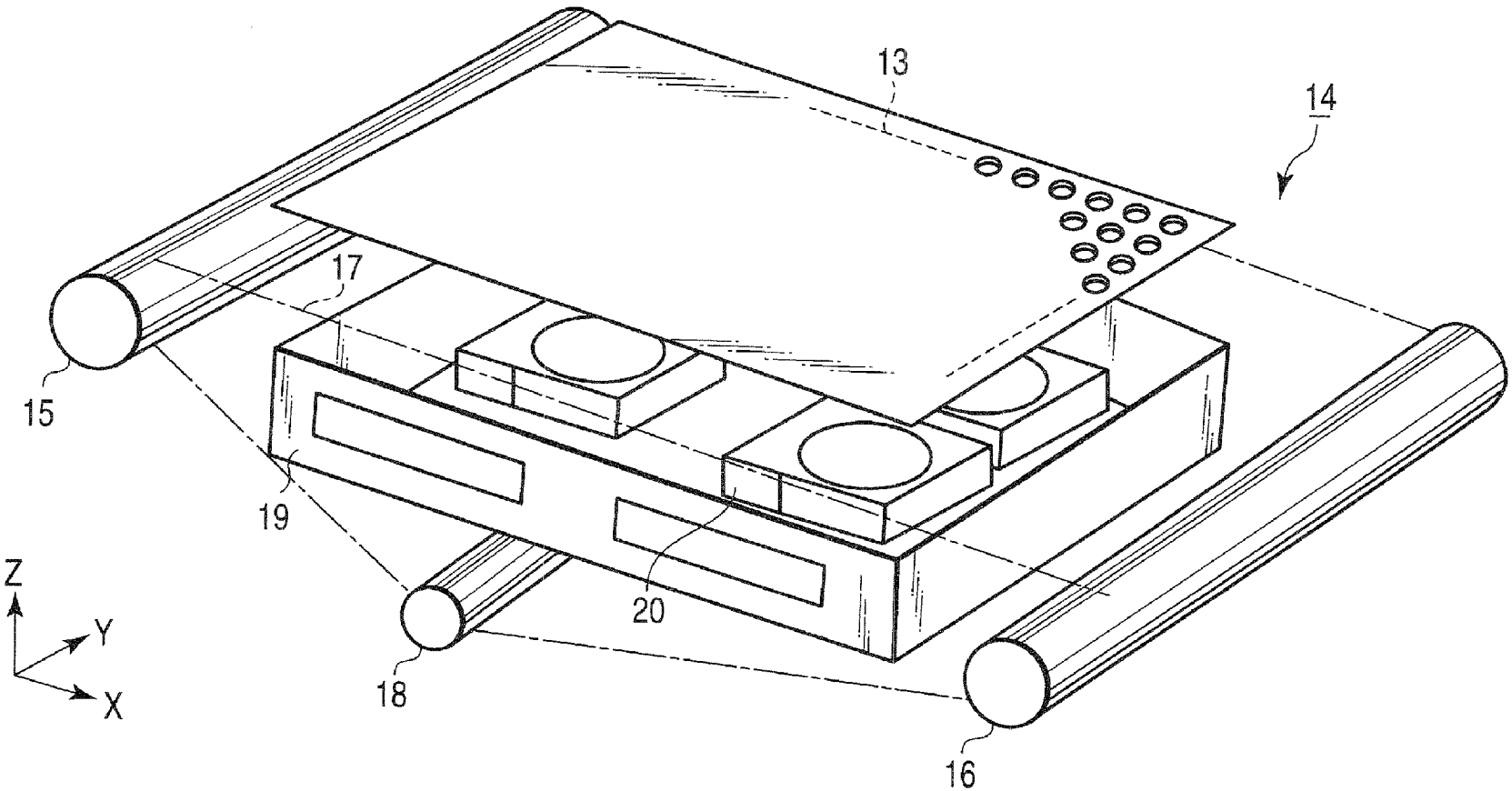
FIG. 3 is a perspective view of a belt conveyor unit.

The belt conveyor unit 14 is liftably supported by a lifting mechanism, not shown, in the arrow direction shown in FIG. 2. FIG. 3 shows a perspective view of the belt conveyor unit 14, in which a driving roller 15 and a driven roller 16 are bridged with a rubber endless belt 17 and tension is applied by a tension roller 18. A chamber 19 which forms a box-shaped space is arranged inside the endless belt 17, and a plurality of absorption fans 20 are provided inside the chamber 19.

A planar platen 13 in which a number of through holes are formed is attached on one surface of the chamber 19, which is the absorption side of the absorption fans 20. The platen 13 is arranged such that nozzle surfaces of the opposed group of recording heads and a surface which is formed by the endless belt 17 and on which the recording mediums 11 are conveyed are parallel with an interval of approximately 1 mm.

Further, a number of holes are formed in the endless belt 17, too. The absorption fans 20 absorb air into the chamber 19 through the holes formed in the endless belt 17 and the holes formed in the platen 13. By means of the negative pressure, the recording mediums 11 are conveyed, being sucked to the surface of the endless belt 17.

In a downstream direction in the direction in which the recording mediums 11 are conveyed by the belt conveyor unit 14 with the above-described configuration, a pair of conveyor rollers 21 and a pair of ejection rollers 22 are provided. An ejection tray 23 containing ejected recording mediums 11 are attached outside the device in the downstream direction in the direction in which the recording mediums 11 are conveyed by the pair of ejection rollers 22. The recording mediums 11 from the belt conveyor unit 14 pass the pair of conveyor rollers 21 and the pair of ejection rollers 22 and are ejected to the ejection tray 23. The tray 23 forms the recoding medium container 6.

A route switching gate 24 is swingably provided between the pair of conveyor rollers 21 and the pair of ejection rollers 22, supported by one end. The route switching gate 24 switches between leading the recording mediums 11 to the pair of ejection rollers 22 and leading the recording mediums 11 to a double-sided conveyor route 25.

The double-sided conveyor route 25 is formed of pairs of conveyor rollers 26-29, for example, and is used when recording is also performed on back surfaces of the recording mediums 11. The pair of conveyor rollers 29 is configured to be switchable between forward and reverse directions. After the rear edge of the recording medium 11 has passed a route switching gate 30, the position of the pair of conveyor rollers is switched. Thereby, the pair of conveyor rollers 29 is reversely rotated, and the direction in which the recording mediums 11 are conveyed is switched. As a result, the recording mediums 11 are fed again toward the pair of resist rollers 12. The surface of the endless belt 17 is arranged to be the same surface as the conveying surface formed by a nip tangent between the pair of resist rollers 12 and the pair of conveyor rollers 21.

Next, the configuration of the image formation unit 4 will be described. The image formation unit 4 is formed of, for example, four-color recording head strings, 20-K (black), 20-C (cyan), 20-M (magenta), and 20-Y (yellow). These recording head strings are arranged one by one in the direction in which the recording mediums 11 are conveyed.

Figure 4:
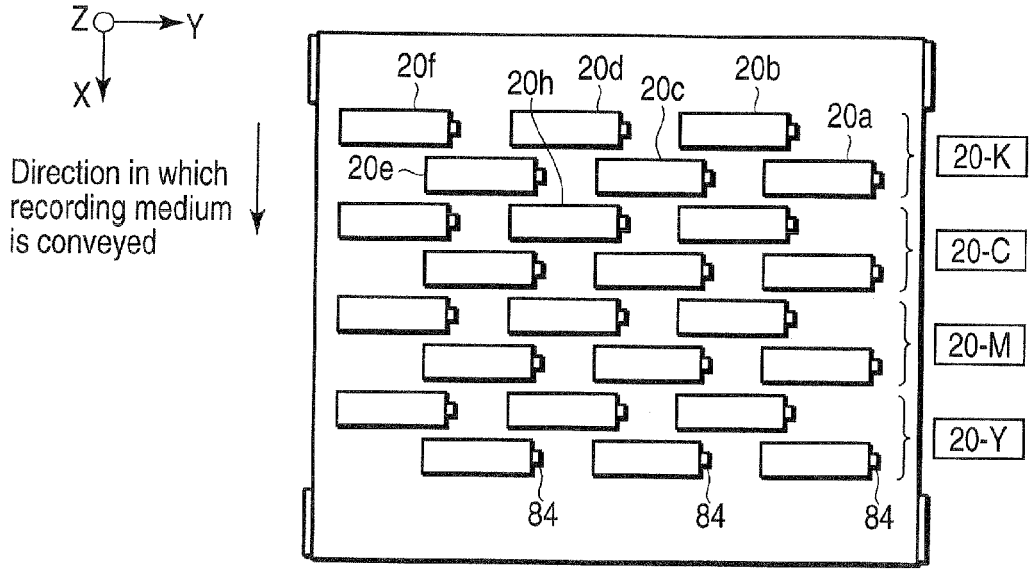
FIG. 4 illustrates a configuration of an arrangement configuration of recording head strings.

FIG. 4 shows a configuration of the arrangement of the recording head strings. As shown in FIG. 4, each of the recording head strings 20-K (black), 20-C (cyan), 20-M (magenta), and 20-Y (yellow) is formed of six recording heads 20*a*-20*f*, and arranged in a staggered manner in a width direction of the recording medium 11. The reference symbol 84 shown in FIG. 4 denotes a temperature sensor which will be described later. The recording heads 20*a*-20*f* are arranged such that parts of the edges of recordable nozzle strings partially overlap with one another when viewed from the direction in which the recording mediums are conveyed.

Next, the configuration of the ink supplier unit 5 will be described in detail with reference to FIG. 1. As shown in FIG. 1, the ink supplier unit 5 is formed of an upstream subtank 40 which supplies ink to the recording heads 20*a*-20*f*, a downstream subtank 41 which stores ink from the recording heads 20*a*-20*f*, and the like. An ink path 34 is connected to the upstream subtank 40, and an ink path 33 is connected to the downstream subtank 41. The recording heads 20*a*-20*f*, forming each of the recording head strings 20-K (black), 20-C (cyan), 20-M (magenta), and 20-Y (yellow), are connected to the ink paths 33, 34.

The ink paths 33, 34 and the recording heads 20*a*-20*f* are connected via the corresponding ink paths 31*a*-31*f* and 32*a*-

32*f*. More specifically, the ink path 33 is connected to the ink paths 31*a*-31*f* and the ink path 34 is connected to the corresponding ink paths 32*a*-32*f*.

The upstream subtank 40 is provided with an actuator 42 for detecting the internal fluid level.

The actuator 42 is swingably attached inside the upstream subtank 40, supported by an end 42*a*. The other end of the support (the end) 42*a* has a float form, which holds air, and a magnet 42*b* is provided in this part. Further, a fluid level sensor 43, formed of a lead switch, is provided in a position opposed to the magnet 42*b* outside of the upstream subtank 40. The height of the fluid level of the upstream subtank 40 is detected by the actuator 42 which swings according to the height of the fluid level.

Similarly, an actuator 44 for detecting the internal fluid level is provided in the downstream subtank 41. The actuator 44 is swingably attached inside the downstream subtank 41, supported by one end 44*a*, as in the case of the actuator 42. The other end of the support 44*a* has a float form, and holds air, and a magnet 44*b* is provided therein. The height of the fluid level of the downstream subtank 41 is detected by a fluid level sensor 45 formed of a lead switch provided outside the downstream subtank 41.

The fluid level of the upstream subtank 40 is designed to be higher than the nozzle surfaces of the recording heads 20 (20*a*-20*f*) by approximately 100 mm (H1). Similarly, the fluid level of the downstream subtank 41 is designed to be lower than the nozzle surfaces by approximately 50 mm. One end of each of air outlet paths 46 and 47, continuous to an upper surface of each of the upstream subtank 40 and the downstream subtank 41, that is, the air outlet paths 46 and 47 are connected to the inside upper area of the upstream subtank 40 and the downstream subtank 41, respectively.

The other end of each of the air outlet paths 46 and 47 is connected to an overflow path 50. A valve 48 is provided at a midpoint of the air outlet path 46, and a valve 49 is provided at a midpoint of the air outlet path 47. The valve 48 is a magnetic valve, and has a normally closed configuration in which the path is closed when the power is interrupted. The valve 49 is also a magnetic valve, but has a normally open configuration in which the path is open when the power is interrupted.

The overflow path 50 has a larger cross-sectional area than that of the other paths, and is provided at a tilt of approximately 5 degrees toward the Z direction, as shown in FIG. 1. One end of the air outlet path 51 is connected to an upper surface of the highest side of the overflow path 50, and a waste path 52 is connected to a lower surface of the lowest side of the overflow path 50. The waste path 52 is connected to a waste bottle 53 provided downstream from the image recording device 1, as shown in FIGS. 1 and 2. The waste bottle 53 is open to the outside via the air outlet path 54.

An ink bottle 55 is provided above the image recording device 1, and is provided at a position higher than the upstream subtank 40. The ink bottle 55 and the upstream subtank 40 are connected via an ink supply path 56, and a valve 57 is provided at a midway point therebetween. The valve 57 has a normal close configuration. An air area exists above the ink bottle 55, and is continuous to the external air through the air outlet path 58 for introducing air into the ink bottle 55. The air outlet paths 51 and 58 are connected to a common air filter 59. The filter has a 5 μm mesh size, for example, and prevents dust contained in the external air from entering the ink path An ink path 60 for sending the inner ink from the downstream subtank 41 toward the upstream subtank 40 connects the upstream subtank 40 with the downstream subtank 41. At a midpoint of the ink path 60, a pump 61 for sending the ink and a heat exchanger 62, which is a temperature adjustment member for transmitting/receiving heat of the ink to/from the pump 61, are connected in series.

The heat exchanger 62 is formed of a material having high thermal conductivity, such as aluminum, copper, stainless, etc., and is formed of a heat exchange route 63 in which the ink flows, a Peltier device 64 which is adhered to the heat exchange route 63 and transmits/receives heat, and a fan 65 for letting waste heat of the Peltier device 64 escape outside.

An ink suction mouth of the ink path 60 is provided inside the downstream subtank 41, and an ink filter 66 is submerged within the ink. When a pump 61 is driven, the ink in the downstream subtank 41 is filtered through the ink filter 66, and transmitted to the upstream subtank 40, after heat is transmitted/received by the heat exchanger 62.

The pump 61 is a diaphragm pump driven by a pulse motor, for example, and the flow rate is controlled by controlling the rotation rate of the pulse motor, mounted on a driving substrate which will be described later.

The downstream subtank 41 is provided with a pressure sensor 67 for measuring the pressure of an air area part inside the downstream subtank 41. When the pump 61 is driven with the air outlet valve 49 of the downstream subtank 41 closed, the pressure inside the downstream subtank 41 becomes negative. The pressure sensor 67 detects the negative pressure and controls the number of rotations of the pulse motor which drives the pump 61 such that the negative pressure is set to a predetermined value. For example, the control is performed such that the rotation rate becomes higher in order to increase the negative pressure, and the rotation rate becomes lower in order to decrease the negative pressure, for example.

Figure 5:
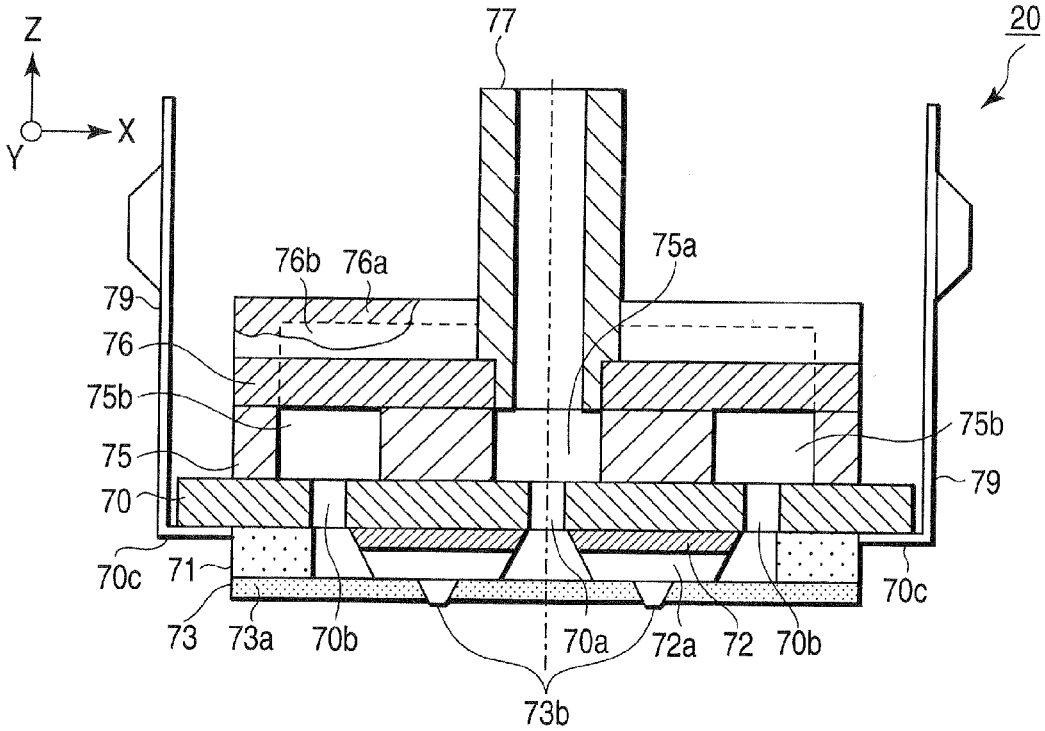
FIG. 5 illustrates an inner configuration of a recording head.

Next, the inner configuration of the recording head 20 will be described with reference to FIGS. 5 and 6. As shown in FIG. 5, in the recording head 20, a frame 71 having a cavity in a central part is adhered to one surface of the base 70. A pair of piezoelectric devices 72 are provided in the cavity and adhered to the same one side of the base 70. The piezoelectric devices 72 and the frame 71 are formed to have the same height to fill the cavity. A nozzle plate 73 is stacked on and adhered to the frame 71 and the piezoelectric devices 72 in the Z direction.

The piezoelectric device 72 has a plurality of grooves formed in the x-axis direction. The grooves become channels 72*a*, and a plurality of nozzle holes 73*b* for ejecting ink to a central part of the groove are provided in a nozzle plate surface 73*a*. The channels 72*a* are formed parallel to the y-axis direction, and the nozzle holes 73*b* are arranged in the y-axis direction accordingly.

The pitch of the groove is approximately 170 μm, and has a width of approximately 85 μm and a width of approximately 300 μm. The pair of piezoelectric devices 72 are staggered half a pitch apart in the y-axis direction.

Figure 6:
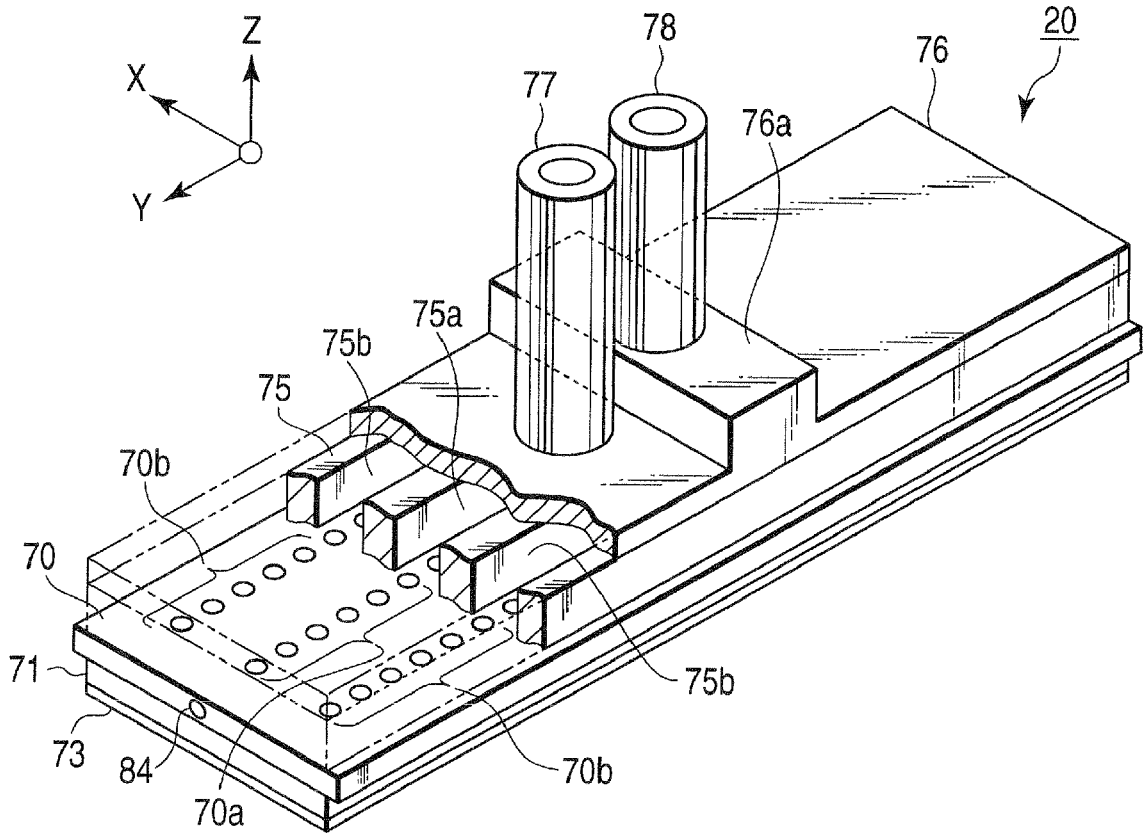
FIG. 6 illustrates an inner configuration of a recording head.

A plurality of holes 70*a* are formed in the base 70 in the y-axis direction, as shown in FIG. 6. Each of the holes 70*a* is approximately 1 mm in diameter and is a through hole arranged at an interval of 3 mm. Similarly, a plurality of through holes 70*b* are arranged in a gap in the y-axis direction between the frame 71 and the piezoelectric devices 72.

Flow path members 75 and 76 are stacked on and adhered to the other surface of the base 70 in the z-axis direction. Three parallel grooves are formed in the flow path member 75. An approach path 75*a* is provided at a position opposed to the holes 70*a* of the base 70, and return paths 75*b* are provided in positions opposed to the holes 70*b*. The flow path member 76 is adhered to lid the three grooves, and two pipe ink ports 77, 78 are vertically provided in the flow path member 76. The hole of the ink port 77 is connected to the approach route 75*a*. On the other hand, the hole of the ink port 78 is connected to a connection flow path 76*b* which connects the two return channels 75*b* inside a convex part 76*a* of the flow path member 76.

The ink path 34 is connected to the ink paths 32 (32*a*-32*f*), and the ink paths 32 (32*a*-32*f*) are connected to the ink port 77. Further, the ink path 33 is connected to the ink paths 31 (31*a*-31*f*), and the ink paths 31 (31*a*-31*f*) are connected to the ink port 78. As a result, the ink supplied from the upstream subtank 40 via the ink paths 34, 32 (32*a*-32*f*) flows into the recording heads 20.

In the recording head 20, the ink is supplied over the full width of the head in the y-axis direction via the approach path 75*a*, and supplied to the central part of the pair of piezoelectric elements 72 from the plurality of holes 70*a* over the full width of the head. The supplied ink is further divided into the direction of each of the piezoelectric devices, passes through the plurality of channels 72*a*, and reaches a gap between the frame 71 and the piezoelectric element 72. After that, the ink from the holes 70*b* passes through the two return routes 75*b*, flow into each other in the connection flow path 76*b*, and is ejected outside the recording head from the ink port 78. The ink supplied from the ink port 78 enters the ink path 33 through the ink paths 31 (31*a*-31*f*), and reaches the downstream subtank 41.

The electrode interconnection with the channel 72*a* of the recording head 20 is shown in FIG. 5. That is, an FPC 79, on which a driver IC is mounted, is connected to an electrode connection surface 70*c* of the base 70, and supplies a voltage power to each channel.

Figure 7:
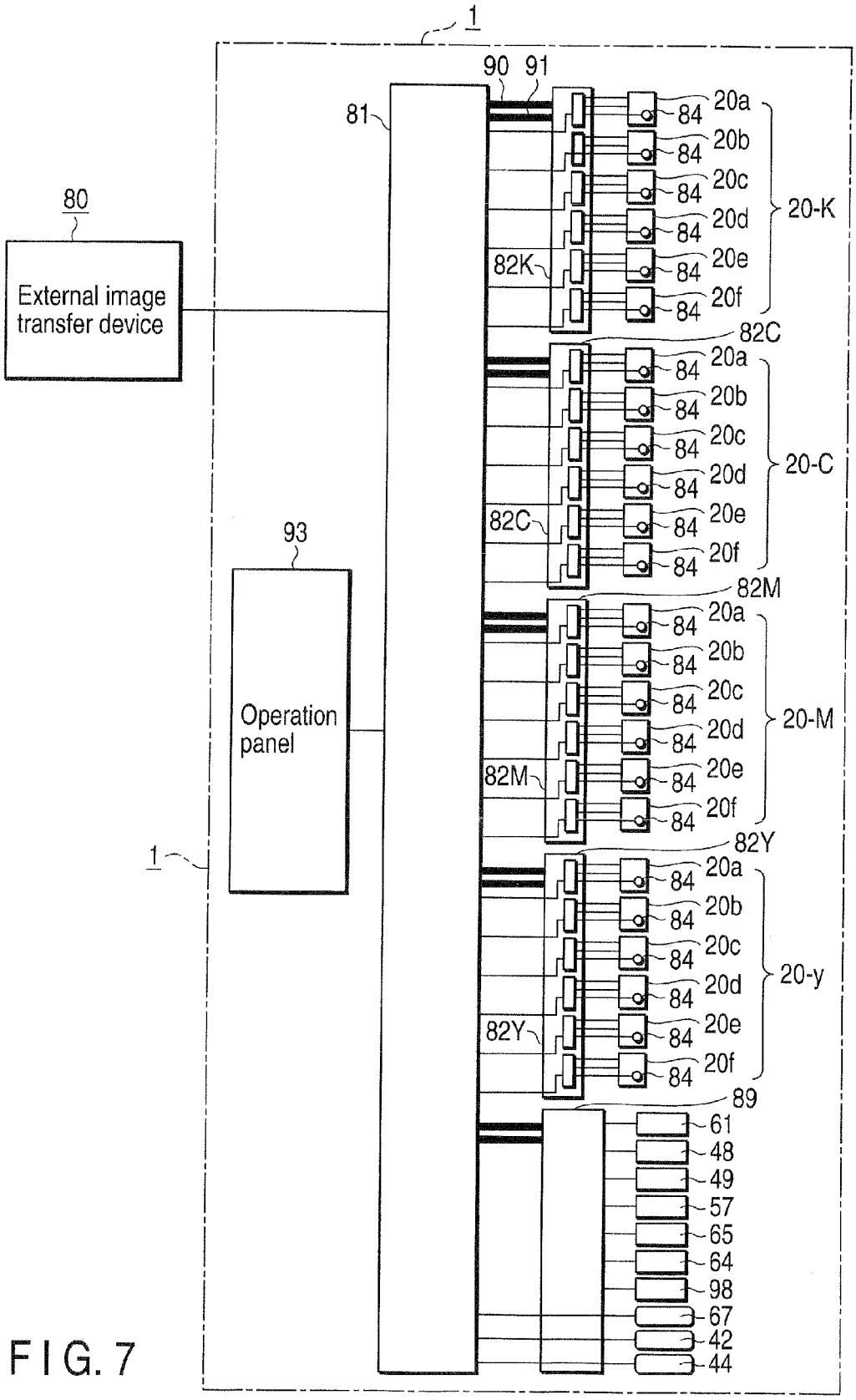
FIG. 7 shows a connection configuration of a control substrate of the image recording device of the present embodiment.

Next, the connection configuration of the circuit substrate of the image recording device 1 of the present embodiment will be described. As shown in FIG. 7, the image recording device 1 of the present embodiment is connected to an external image transfer device 80 such as a personal computer (PC) as a host device. An image recording information is transferred from the external image transfer device 80 to a control substrate 81, which is a control means of the recording head 20. In this image recording information, the image recording information about black (K) is supplied to a driving circuit 82K, and the image recording information is further transferred from the driving circuit 82K to the six recording heads 20*a*-20*f*. Similarly, the image recording information about cyan (c), magenta (M) and yellow (Y) is supplied to the respective driving circuits 82C, 82M, and 82Y, and further transferred to the respective six recording heads 20*a*-20*f*.

The base 70 of the recording head 20*s* (20*a*-20*f*) is formed of a metal such as aluminum, which exhibits a sufficiently higher thermal conductivity than the piezoelectric device 72. A temperature sensor 84, which is a thermistor, is attached to the base 70. Each driving circuit controls the voltage applied to the piezoelectric device 72 and its signal (waveform) according to the output from the temperature sensor 84.

The power is supplied from the control substrate 81 to the driving circuits 82K, 82C, 82M, and 82Y via a power supply line 90, and various signals are transferred between the control substrate 81 and the driving circuits 82K, 82C, 82M, and 82Y via a signal line 91. Further, an operation panel 93 is formed of a key operating section and a display, not shown, and transmits a key operation signal to the control substrate 81 and receives display data to be displayed on the display from the control substrate 81.

Further, the control substrate 81 is connected to the actuator 89. The control substrate 81 controls the actuator 89 based on control signals output from the control base 81, and controls driving of the pump 61, the valves 48, 49, 57, the cooling fan 65, the Peltier device 64, the head cooling fan 98, the pressure sensor 67, and the fluid level sensors 42, 44, which are connected to the actuator 89.

Figure 8:
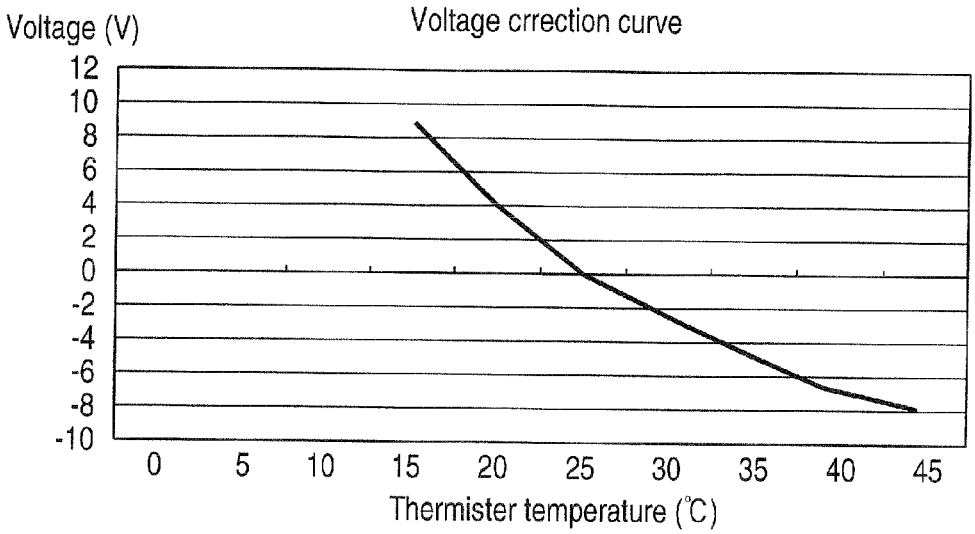
FIG. 8 shows voltage correction characteristics.

FIG. 8 shows an example of temperature control performed by a control circuit mounted on the control substrate 81. The output from the temperature sensor 84 indicates a value approximately the same as the temperature of the ink flowing inside the recording head 20, since the base 70 is formed of a material having high thermal conductivity. Further, since the viscosity of ink changes according to the temperature of the ink, the voltage applied to the piezoelectric device 72 must be set to a value suitable to the viscosity in order to eject the same amount of ink constantly.

FIG. 8 shows a case where the voltage must be controlled based on the voltage value of the recording head 20. In this case, the control must be made by decreasing the voltage when the detection temperature is high, and by increasing the voltage when the detection temperature is low. A table for increasing and decreasing the voltage according to the temperature is mounted on each of the driving circuits 82K, 82C, 82M, and 82Y. The driving circuits 82K, 82C, 82M, 82Y perform the control in the corresponding recording heads 20.

When the piezoelectric device 72 is driven and ink is ejected from the nozzle holes 73*b*, the piezoelectric device 72 generates heat. A part of the heat is emitted outside along with the ejected ink. Further, another part of the heat is transmitted to the base 70, and emitted outside the recording head 20. However, the main part of the heat is accumulated in the base 70 and the flow path members 75, 76. Therefore, in order to prevent an increase in temperature of the recording head 20, the ink is supplied from the ink port 87 of the recording head 20 and ejected from the ink port 88 to circulate the ink and emit heat.

Next, the circulation operation of ink will be described. As shown in FIG. 1, in a stopped state, the downstream subtank 41 is continuous to the overflow path 50, the air outlet path 51, and the air filter 59, and open to the air, since the valve 49 of the air outlet path 47 is open. On the other hand, the upstream subtank 40 is hermetically closed since the valve 48 is closed. Therefore, since the fluid level of the downstream subtank 41 is lower than the nozzle surfaces 73*a* of the recording heads 20 by approximately 50 mm (H2), meniscuses are formed in the nozzle holes 73*b* due to the negative pressure, and the ink does not flow from the recording heads 20 in this state.

Next, preparatory to recording on the recording mediums 11, the valves 48, 49 and the pump 61 are driven simultaneously. As a result, the valve 49 is closed and the pump 61 is driven, and thereby a negative pressure is applied into the downstream subtank 41. Further, since the upstream subtank 40 is higher in position than the nozzle surfaces 73*a* by approximately 100 mm (H1), the valve 48 is opened and a positive pressure is applied to the nozzle surface 73*a*.

Since the pump 61 controls the internal pressure of the downstream subtank 41 to a predetermined pressure, as described above, the nozzle holes 73*b* reaches a predetermined negative pressure immediately. Assuming that the specific gravity of the ink is 1 g/cm$^3$, for example, a positive pressure of 1 kPa is applied due to the height of the fluid level of the upstream subtank 40, and a pressure of −0.5 kPa is applied due to the height of the fluid level of the downstream subtank 41.

When the negative pressure generated by the pump 61 is −5 kPa, for example, the difference in pressure between the upstream subtank 40 and the downstream subtank 41 is 6 kPa in total. The ink meniscuses in the nozzle holes 73*b* of the recording heads 20 are not destroyed up to a certain negative pressure because of the surface tension of the ink and the diameter of the nozzle holes. Therefore, by controlling the pump 61 to keep the pressure within that negative pressure range, the ink flows from the upstream subtank 40 to the downstream subtank 41 through the recording heads 20*a*-20*f*, 73*b* or causing ink to leak.

Further, the ink is returned to the upstream subtank 40 through the ink path 60 from the downstream subtank 41 by the pump 61, and thereby the ink circulates. In this state, by operating the feed roller 9 to carry the recording mediums 11 and driving the recording heads 20*a*-20*f* opposed to the recording mediums 11 on the belt conveyor unit 14, the ejected ink drops adhere to the recording medium 11.

After the ink is consumed by the ejection of the ink to the recording mediums 11, the fluid level of the upstream subtank 40 becomes lower, and the fluid level sensor 42 detects a decrease in the ink fluid level. In this case, the valve 57 is opened and the ink is supplied to the upstream subtank 40 from the ink bottle 55. The ink is supplied under its own weight from the ink bottle 55 to the upstream subtank 40 because of the difference in fluid level from the ink bottle 55.

Figure 9:
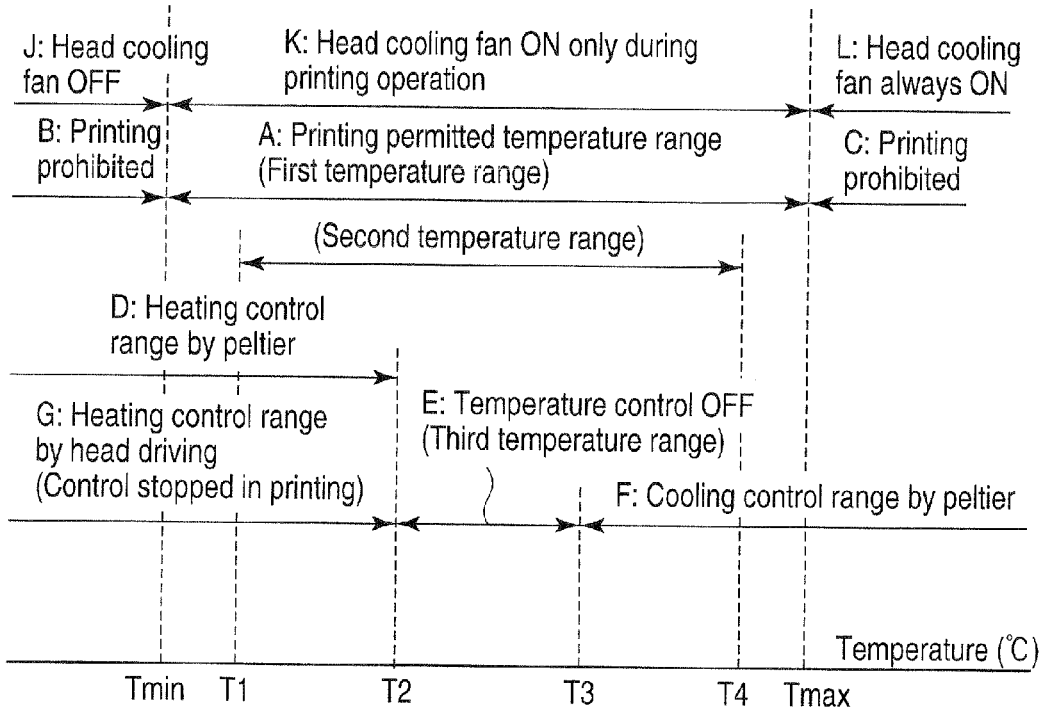
FIG. 9 is a diagram showing the relationship between ink ejected from a recording head and the temperature, in which the ink temperature corresponds to the lateral axis.

FIG. 9 is a graph showing the relationship between ink ejection from the recording head 20 and the temperature, in which the lateral axis corresponds to the ink temperature. As described above, the recording head 20 has a range of ink temperatures in which the ink can be ejected. Assuming that the range is A. A is between the minimum temperature Tmin and the maximum temperature Tmax (which range will be denoted as a first temperature range hereinafter). The first temperature range differs according to the kind of ink, but is generally between 15 and 35° C.

The image recording device 1 may be installed in various environments. The ink temperature immediately after the power is turned on may be lower than Tmin or higher than Tmax depending on the season or the installation environment. Therefore, the ink temperature is detected by the temperature sensor and is controlled by setting the temperature lower than Tmin as a print prohibited area B, and setting the temperature higher than Tmax as a printing prohibited area C. In the printing prohibited ranges B and C, an image recording operation is prohibited, and the ink temperature is controlled to be kept within a preferable first temperature range (A).

As a temperature sensor for controlling the ink temperature, the temperature sensor 84 provided in each recording head for voltage control of the recording head 20 is used. As a heating means, the heat exchanger 62 provided in the ink path 60 is used. More specifically, the heat exchange path 63 is heated or cooled in a direction in which a current flows by using the Peltier device 64. That is, by driving the pump 61 to make the ink circulate and cause the ink to pass through the heat exchanger 62, the ink is heated or cooled.

As another heating means, the recording head 20 is driven. The driving pressure waveforms of the recording heads 20 include a first waveform which ejects ink and a second waveform which vibrates the piezoelectric device 72 without ejecting ink. When the ink is heated, the piezoelectric device 72 is vibrated using the second waveform, without ejecting the ink from the nozzle holes 73*b*.

By driving the recording heads 20 in such waveforms, the heat generated by the piezoelectric device flows inside the recording head 20 and is supplied to the circulating ink, thereby heating the ink. Since the ink circulates inside the microscopic channels 72*a*, the recording heads 20 themselves function as temperature adjustment members, and are used by being vibrated and heated.

As described above, as heating means, the Peltier device 64 and the recording head 20, which is controlled by being vibrated and heated are used. As a cooling means, the controllable Peltier device 64 is used. As shown in FIG. 9, in the present embodiment, the first temperature range (the printable temperature range A) further includes a second temperature range and a third temperature range (denoted by E) included in the second temperature range. Therefore, in the present embodiment, four temperature values, T1, T2, T3, and T4 are used, other than Tmin and Tmax, and the temperature values T1, T2, T3, T4 are set such that the following relation is satisfied: Tmin<T1<T2<T3<T4<Tmax. Here, the intermediate values between T1 and T4 and T2 and T3 are set to be approximately the same as the intermediate value between Tmin and Tmax.

The range denoted by T2<T<T3 is the third temperature range. In this temperature range, the temperatures of the Peltier device 64, the recording heads 20, and the like do not need to be controlled at all, and the temperature control is stopped. The third temperature range is a target temperature of the temperature control. The temperature value may be a specific value which satisfies the relationship of T2=T3, as shown in the third temperature range. If the ink temperature exceeds the temperature range (second temperature range) of T1≦T≦T4, the temperature control is performed by starting a circulation operation even in a standby state, as will be described later.

Figure 10:
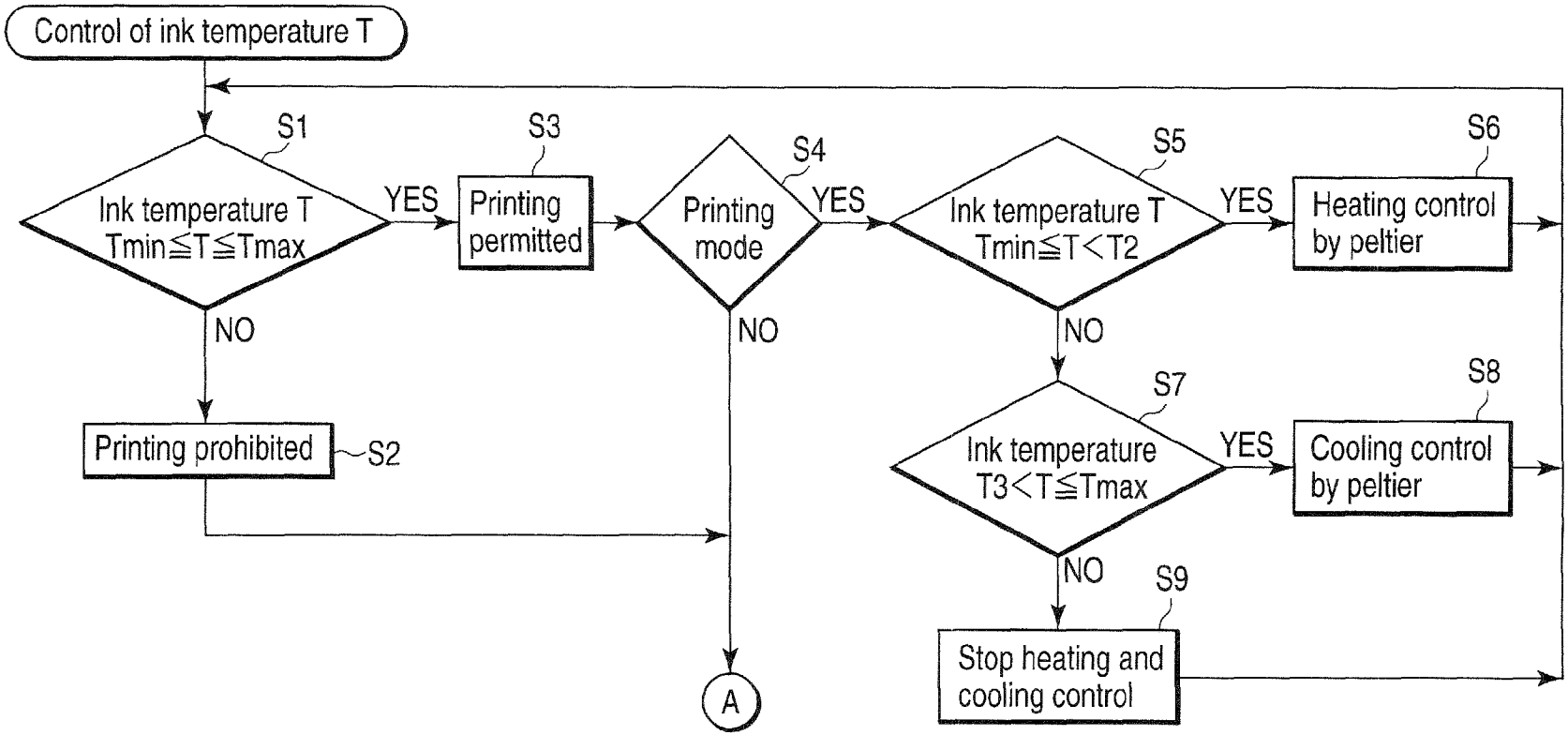
FIG. 10 is a flowchart illustrating the basic procedure of temperature control of the present embodiment.
Figure 11:
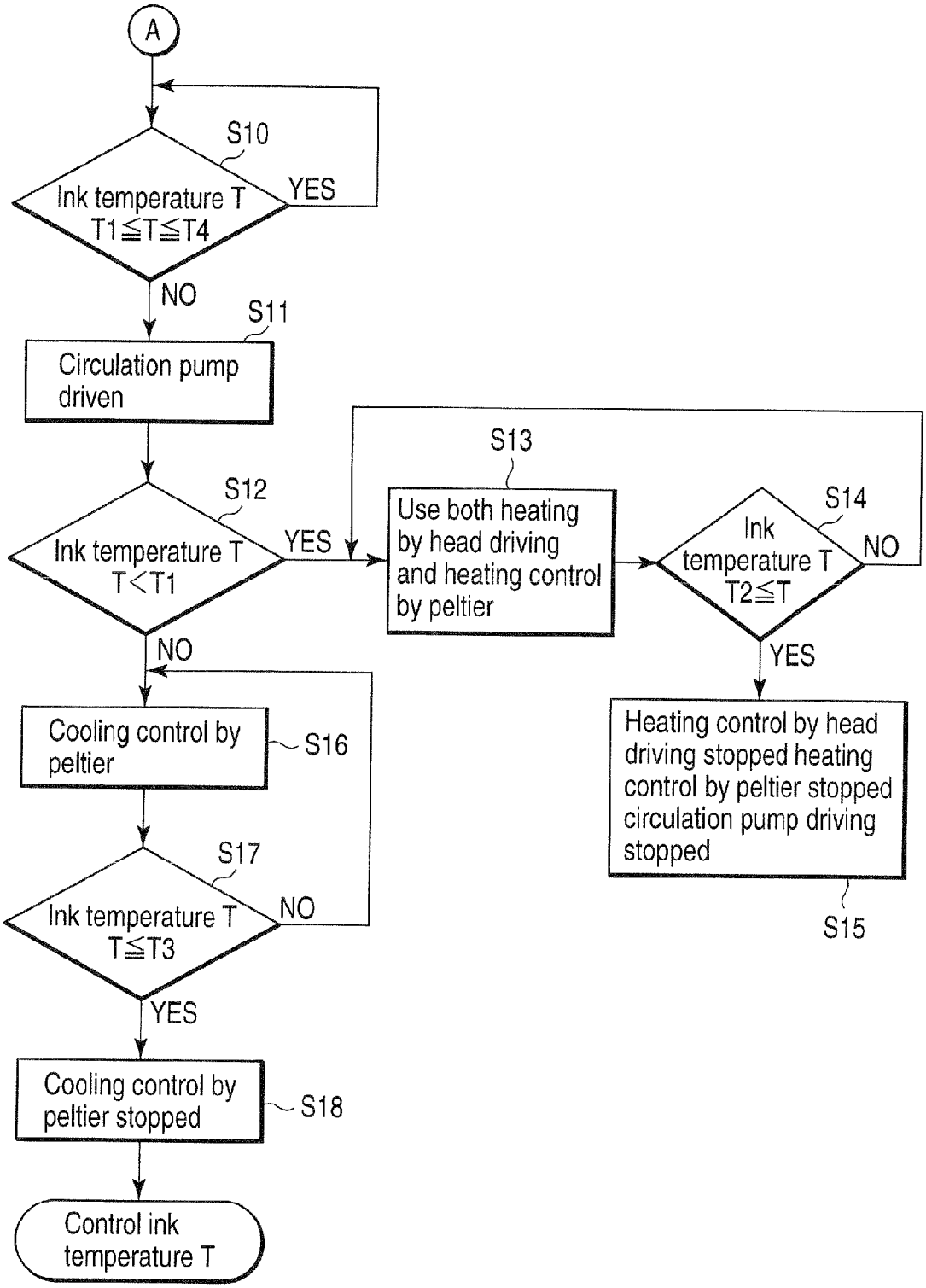
FIG. 11 is a flowchart illustrating the basic procedure of temperature control of the present embodiment.

The ink temperature control method with the above-described configuration will be described below. FIGS. 10 and 11 are flowcharts illustrating the basic procedures of the temperature control of the present embodiment. First, the ink temperature control is performed according to the flowchart shown in FIG. 10. A CPU, not shown, mounted on the control substrate 81 constantly monitors the ink temperature, and determines whether the ink temperature T is within the printable temperature range A (first temperature range) (step (hereinafter abbreviated as S) 1). That is, by causing the temperature sensor 84 to measure the ink temperature, it is determined whether the ink temperature T is within the range of Tmin≦T≦Tmax.

When the ink temperature T is out of the printable temperature range (first temperature range) (NO in S1), the printing operation is prohibited (S2). When the ink temperature T is within the printable temperature (YES in S1), which means printing is permitted (S3), a standby state is set until a printing instruction is given (S4). That is, in this case, since the ink temperature is within the printable range of Tmin≦T≦Tmax, a standby state is kept until a key operation is performed via the operation panel 93 and a printing instruction is given from CPU.

In this state, when a printing instruction is given and the image recording device 1 shifts to a printing mode (YES in S4), it is determined whether the ink temperature T is within the range of Tmin≦T≦T2 (S5). When the ink temperature T is within the range of Tmin≦T≦T2 (YES in S5), heating control is performed using the Peltier device 64 (S6). That is, in this case, the ink temperature T is higher than Tmin, but lower than T2. Therefore, by controlling heating of the ink using the Peltier device 64, the ink temperature T is controlled so as not to be lower than Tmin, and thereby the ink temperature T is made closer to the optimum third temperature range.

When the ink temperature T is out of the range of Tmin≦T≦T2 (NO in S5), it is determined whether the ink temperature T is within the range of T3≦T≦Tmax (S7). When the ink temperature T is within the range of T3≦T≦Tmax, (YES in S7), cooling control is performed using the Peltier device 64 (S8). That is, in this case, the ink temperature T is lower than Tmax, but higher than the temperature T3. Therefore, by performing cooling control using the Peltier device 64, the ink temperature T is controlled so as not to be higher than Tmax and is made closer to the optimum third temperature range.

When the ink temperature T is out of the range T3≦T≦Tmax (NO in S7), heating and cooling control by the Peltier device 64 is stopped (S9). That is, in this case, the ink temperature T is within the range of T2≦T≦T3 (third temperature range), and the ink temperature T is the optimum temperature for ejecting ink to the recording mediums 11, and the temperature control by the Peltier device 64 is stopped.

When the image recording device 1 is in a standby mode, the ink temperature T is controlled according to the flowchart shown in FIG. 11. First, it is determined whether the ink temperature T is within the range of T1≦T≦T4 (second temperature range) (S10). When the ink temperature T is within the second temperature range (YES in S10), the image recording device 1 is kept in this state.

When the ink temperature T is out of the second temperature range (NO in S10), the circulation pump 61 is driven (S11), and it is determined whether the ink temperature T satisfies the relationship of T<T1 (S12). When the ink temperature T satisfies the relationship of T<T1 (Yes in S12), the ink temperature T is lower than the printable range. In this case, the recording head 20 is driven and the heating control is performed by the Peltier device 64 (S13). That is, by driving the circulation pump 61, the ink is circulated and heating control is performed by the Peltier device 64, and the second waveform is supplied to the recording heads 20 and the vibration heating is performed.

After that, it is determined whether the ink temperature T has exceeded T2 (S14). The above-described procedure is repeated until the ink temperature T exceeds the temperature T2 (No in S14, S13). Since the heating control includes both heating by the Peltier device 64 and the heating by driving the recording heads 20, the ink temperature T can be raised rapidly. Therefore, when the ink temperature T exceeds T2 after that, the driving of the recording head 20 and the heating control by the Peltier device 64 are stopped (S15).

When the ink temperature T does not satisfy the relationship of T<T1 (NO in S12), it can be determined that the ink temperature T is higher than the second temperature. In this case, cooling control is performed by the Peltier device 64 (S16). That is, the circulation pump 61 is driven to circulate the ink and cooling control is performed by the Peltier device 64.

After that, it is determined whether the ink temperature T has become lower than T3 (S17), and the above-described procedure is performed until the ink temperature T becomes lower than T3 (NO in S17, S16). When the ink temperature T has become lower than T3, the driving of the circulation pump 61 is stopped, and the cooling control by the Peltier device 64 is stopped (S18).

After that, the ink temperature T is monitored constantly. When the ink temperature T becomes out of the second temperature range, that is, when the ink temperature T has satisfied the relationship of T<T1 or T4<T, the circulation pump 61 is driven automatically and the ink circulation is restarted.

Figure 12:
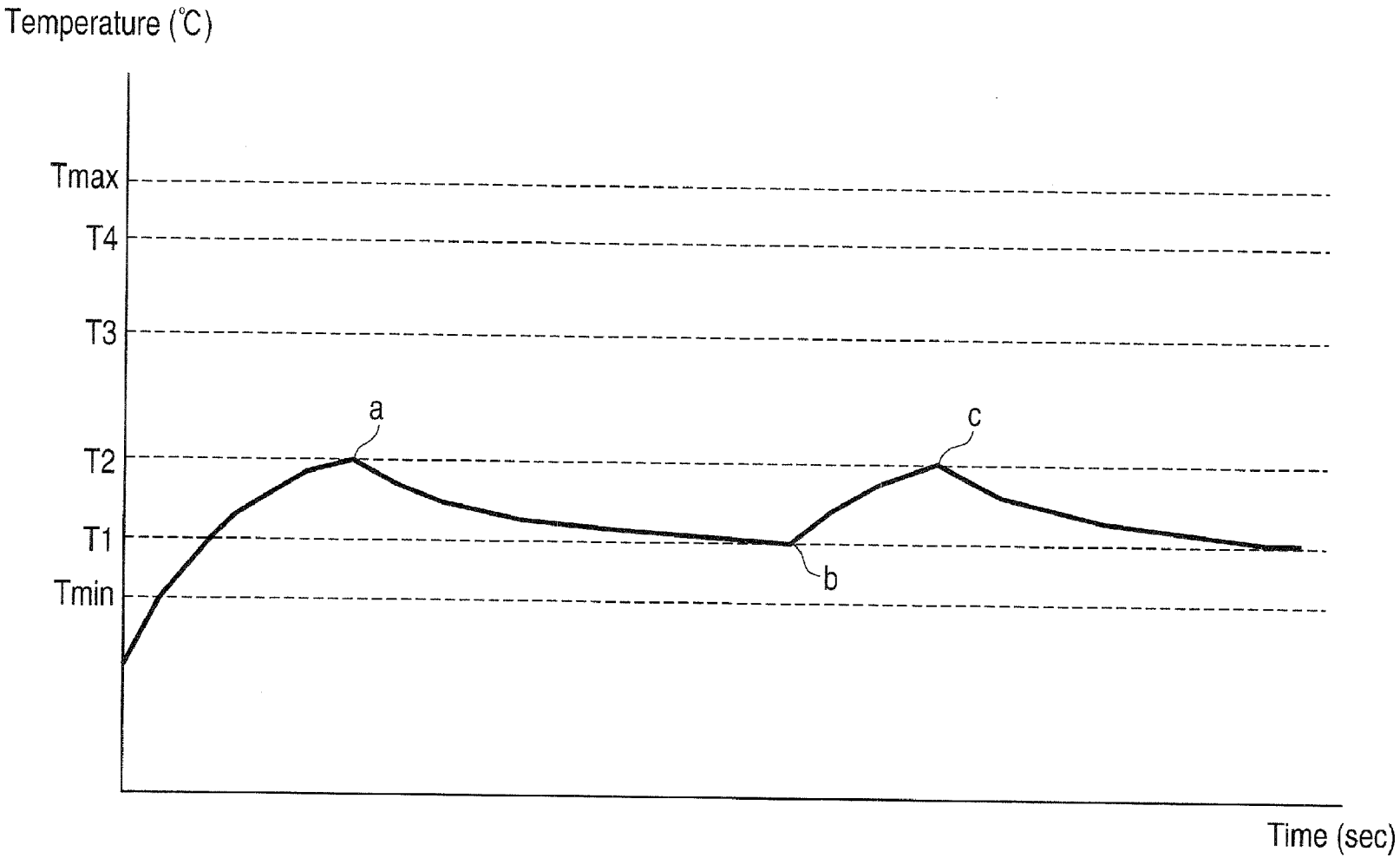
FIG. 12 shows adjustment of the ink temperature of the image recording device from a power-on state.
Figure 13:
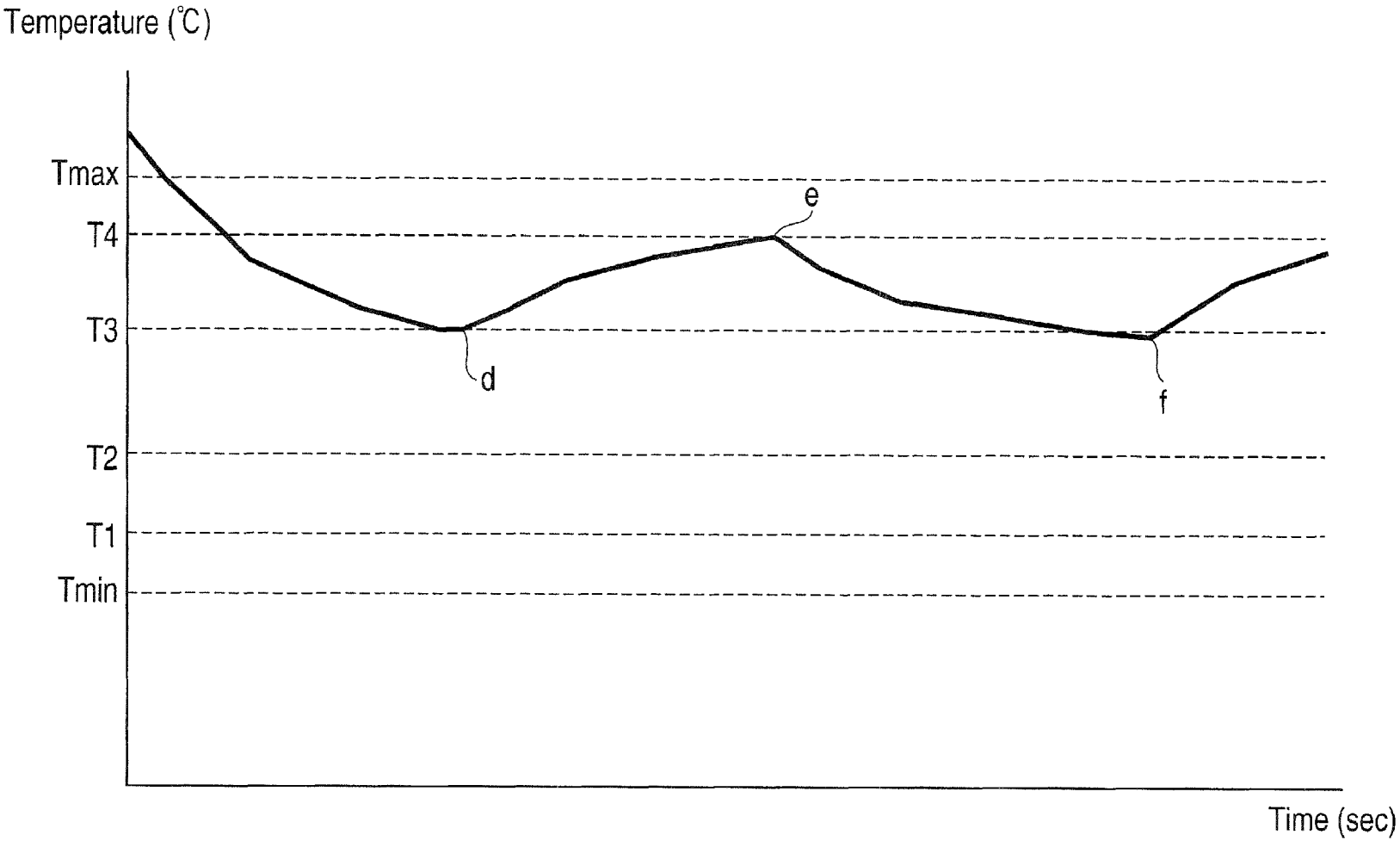
FIG. 13 shows adjustment of the ink temperature of the image recording device from a power-on state.

FIGS. 12 and 13 show examples in which the above-described operations in the standby state are monitored from the power-on state.

FIG. 12 shows a case where the power is turned on in a room temperature lower than Tmin and the ink temperature control status is monitored. In this case, the ink temperature lower than Tmin is raised after the ink circulation starts, due to use of both the Peltier device 64 and the vibration heating of the recording heads 20. After that, when the ink temperature has exceeded Tmin, the printing prohibition is released, but when a printing instruction is not given, the control is maintained until the ink temperature exceeds the temperature T2 (a shown in FIG. 12). In this case, the ink circulation control is stopped, too.

After that, the ink temperature gradually lowers, and when the ink temperature becomes lower than the temperature T1, the ink circulation control and the temperature control are automatically restarted (b shown in FIG. 12). The above-described procedures are repeated by stopping the control when the ink temperature T has exceeded T1 (c shown in FIG. 12).

FIG. 13 shows a case where the power is turned on at a room temperature higher than Tmax. In the same way as in the above-described case, the ink circulation control and the temperature control are started, and the ink temperature gradually decreases due to the cooling operation by the Peltier device 64. When the ink temperature T has become lower than Tmax, the printing prohibition is released, but the control is maintained regardless of whether the printing instruction is given or not, and when the ink temperature T has become lower than T3, the ink circulation control and the temperature control are stopped (d shown in FIG. 13).

In this case, the ink temperature keeps on rising and when the ink temperature exceeds T4, the ink circulation control and the temperature control are automatically restarted (e in FIG. 13). When the ink temperature becomes lower than T3 again, the ink circulation control and the ink control are stopped (f shown in FIG. 13). By thus performing control and automatically performing ink circulation and temperature control, the image recording device 1 can be constantly maintained in a printable state.

According to the above-described procedures, the ink temperature can be monitored even in a standby state such that the ink temperature does not exceed the temperature range having the minimum temperature and the maximum temperature in which printing is permitted. When the ink temperature approaches the minimum or maximum temperature, the circulation operation is automatically performed, and the temperature control is performed such that the ink temperature is between the minimum temperature and the maximum temperature. Thereby, when a printing instruction is given, printing can be started immediately, and a waiting time involved in temperature control can be decreased.

Further, by controlling the ink temperature T in a standby state within the second temperature range which is still a printable range but is broader than the third temperature range, instead of the optimum third temperature range, the power consumption of the Peltier device 64 can be decreased.

Next, the control method for detecting the ink temperature using the temperature sensors 84 of the recording heads 20 will be described below. As shown in FIG. 4, in the present embodiment, the six recording heads 20*a*-20*f* are used for each color, and the 24 recording heads 20 are used in four colors. When the recording heads 20 are used for vibration heating, the second waveform may be applied to all the recording heads 20. In this case, however, the temperature sensor 84 provided in each recording head cannot detect heat of the recording head itself and cannot precisely detect the temperature of the circulating ink.

Figure 14:
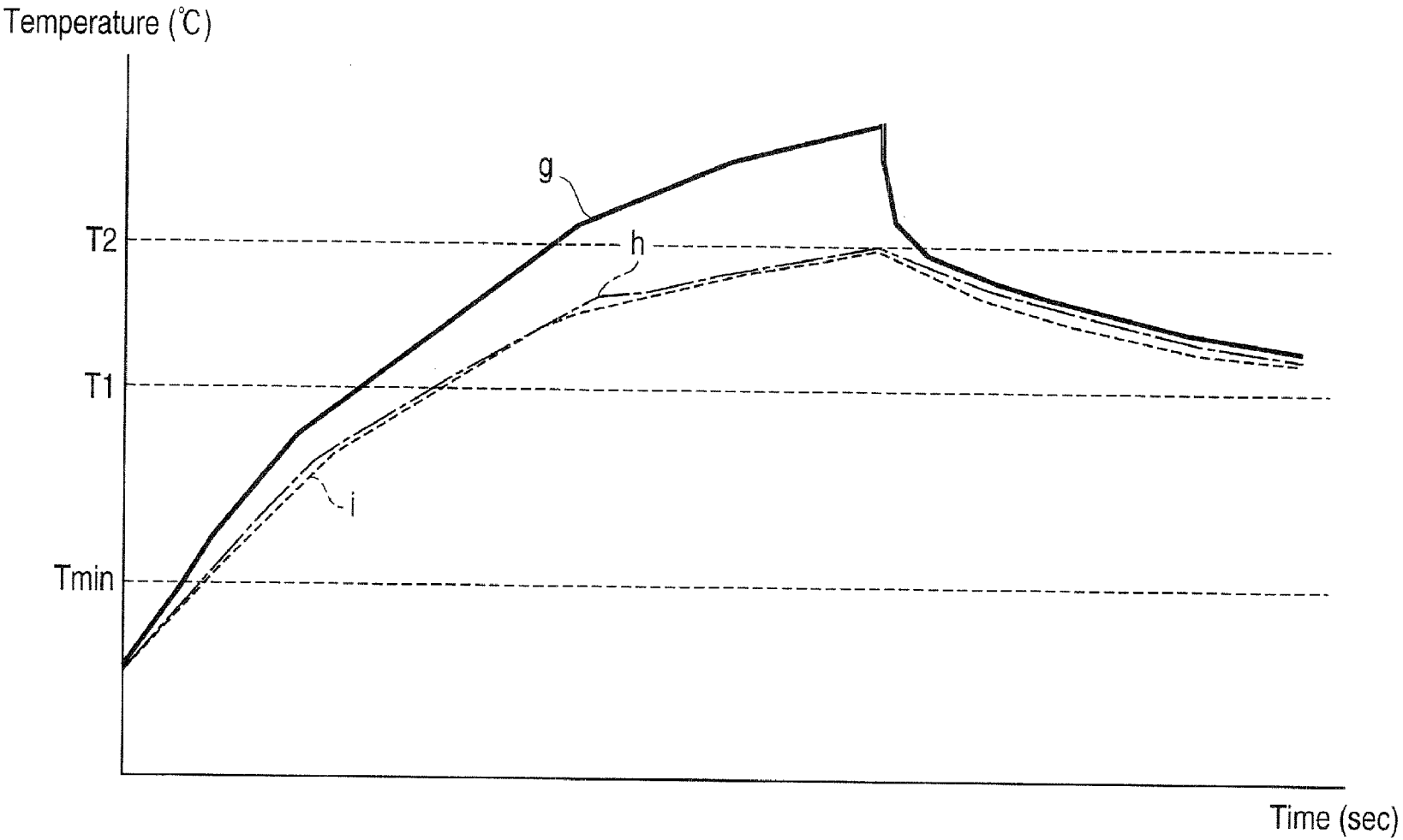
FIG. 14 shows comparison of detection values detected by the temperature sensors during heating control.

The reason for this is shown in FIG. 14. Assume that a temperature sensor 97 is added inside the upstream subtank 40, and the ink temperature T is acquired for comparative reference (see FIG. 15, in which the same members as those of FIG. 1 are denoted by the same reference numerals and structural descriptions of such members will be omitted).

In this case, as shown by the solid line (curved line g) in FIG. 14, the temperature sensor 84 of the vibrated and heated recording head has a higher temperature than the actual ink temperature T. This is because of the high thermal conductivity of the base 70 of the recording head 20 and the function of the recording head 20 itself as a heater to heat the ink. On the other hand, the temperature sensor 84 of a recording head which is not driven for heating exhibits a temperature change shown by the broken line (curved line h), which is closer to the change of the temperature sensor 97 for comparative reference shown by the single-dotted chained line (curved line i).

This can be known from the fact that the value of the temperature sensor 84 of the recording head 20 which has been vibrated and heated rapidly lowers when the heating control is stopped when the value of the referential temperature sensor 97 reaches T2, which is the upper limit of the heating temperature control range, because of the small heat capacity of the recording head 20 itself.

Therefore, by specifying the non-driven head to which the second waveform is not applied at the time of vibration heating as a temperature measurement head, the temperature of the circulating ink can be measured without providing the temperature sensor 97 with the above-described configuration in the subtanks or the ink paths, and thereby precise temperature control can be realized.

Figure 16:
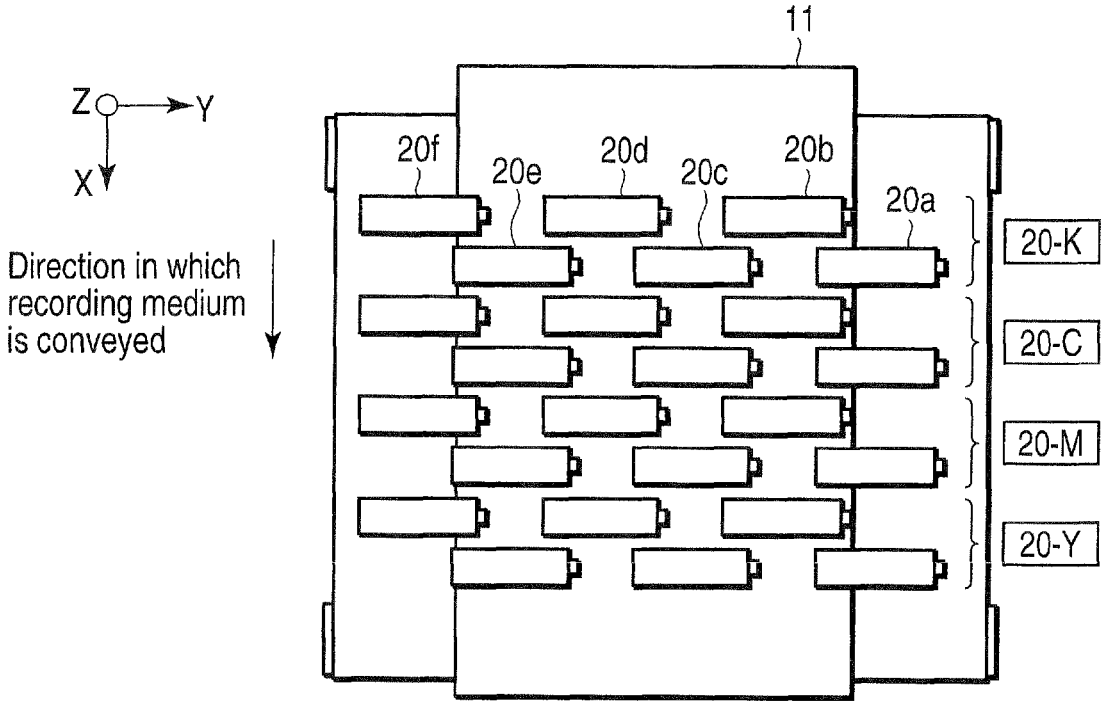
FIG. 16 shows an overall configuration of recording head strings in which six recording heads are provided per color.

Further, when printing on the recording medium 11 is performed using the 24 recording heads forming the recording head strings 20-K (black), 20-C (cyan), 20-M (magenta), and 20-Y (yellow), as shown in FIG. 16, the temperature of the recording head 20 (such as the recording head 20*c*) having a high printing rate rises in some degree due to the generated heat, but the recording head 20 (such as the recording heads 20*a*, 20*f*) which has a low printing rate makes little contribution to printing and generates a small amount of heat. In particular, when the width of the recording medium 20 is small, the recording head 20 positioned outside the recording medium 20 does not eject ink at all. Further, the recording head (such as the recording heads 20*a* and 20*f* shown in FIG. 16) which is opposed to the recording medium 20 only at a part of the nozzle ejects a very small amount of ink and generates little heat.

From the viewpoint of ink reception amount of the recording medium 11, the following can be said. That is, in general, all the recording heads 20 cannot eject ink from all the nozzles simultaneously, since the ink reception amount of the recording medium 11 is limited. As a guide, half the amount of ink ejected from the recording heads 20 of the four colors in total is the maximum value which can be received by the recording medium 11.

Accordingly, the recording heads 20 of the 24 colors necessarily include recording heads which do not contribute to printing. Therefore, the temperature of the circulating ink can be controlled by regarding the lowest temperature detection value in one color or from among the output values from the temperature sensors 84 of all the recording heads 20 of the 4 colors as an ink temperature.

Figure 15:
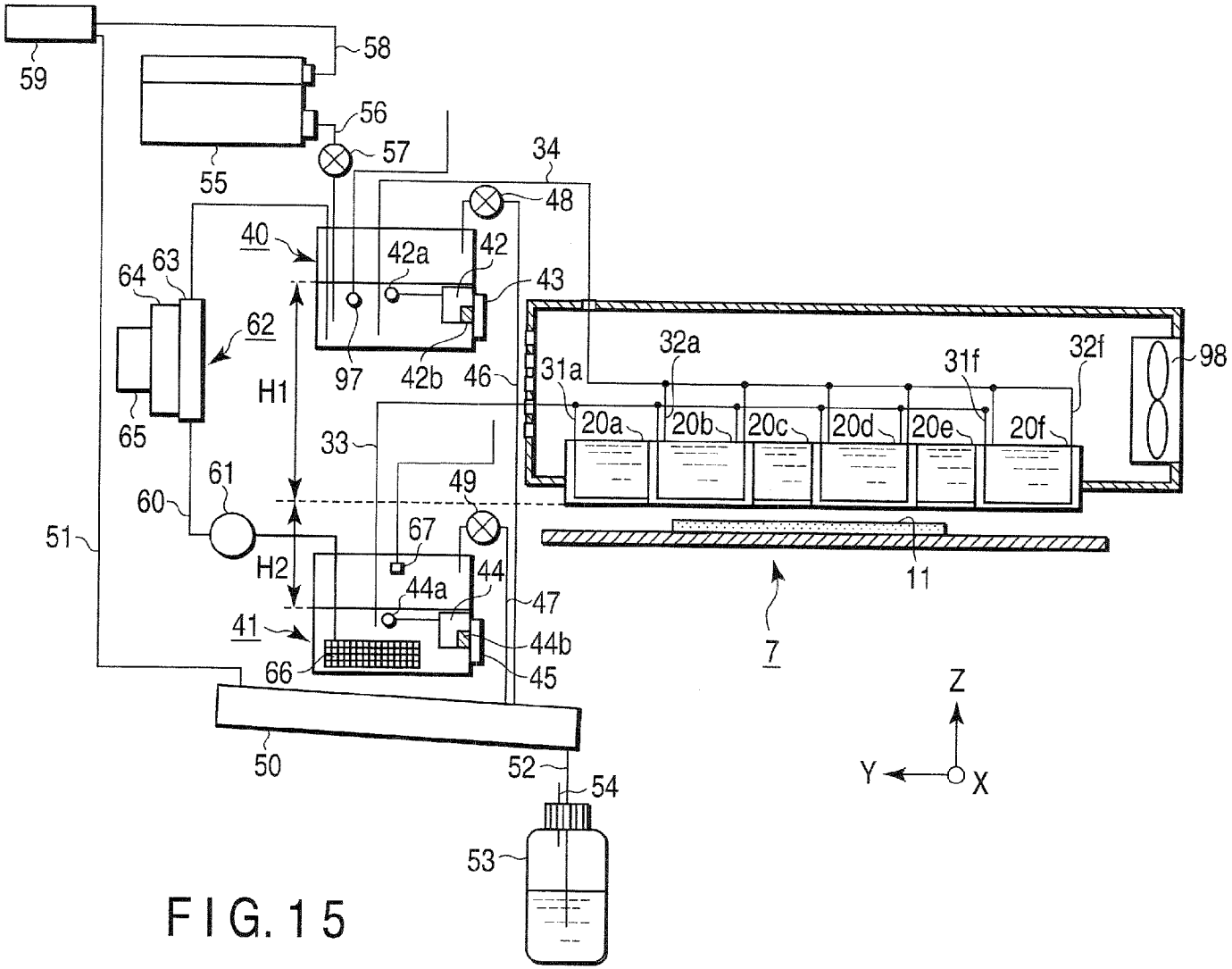
FIG. 15 illustrates an arrangement configuration of a referential temperature sensor.
Figure 17:
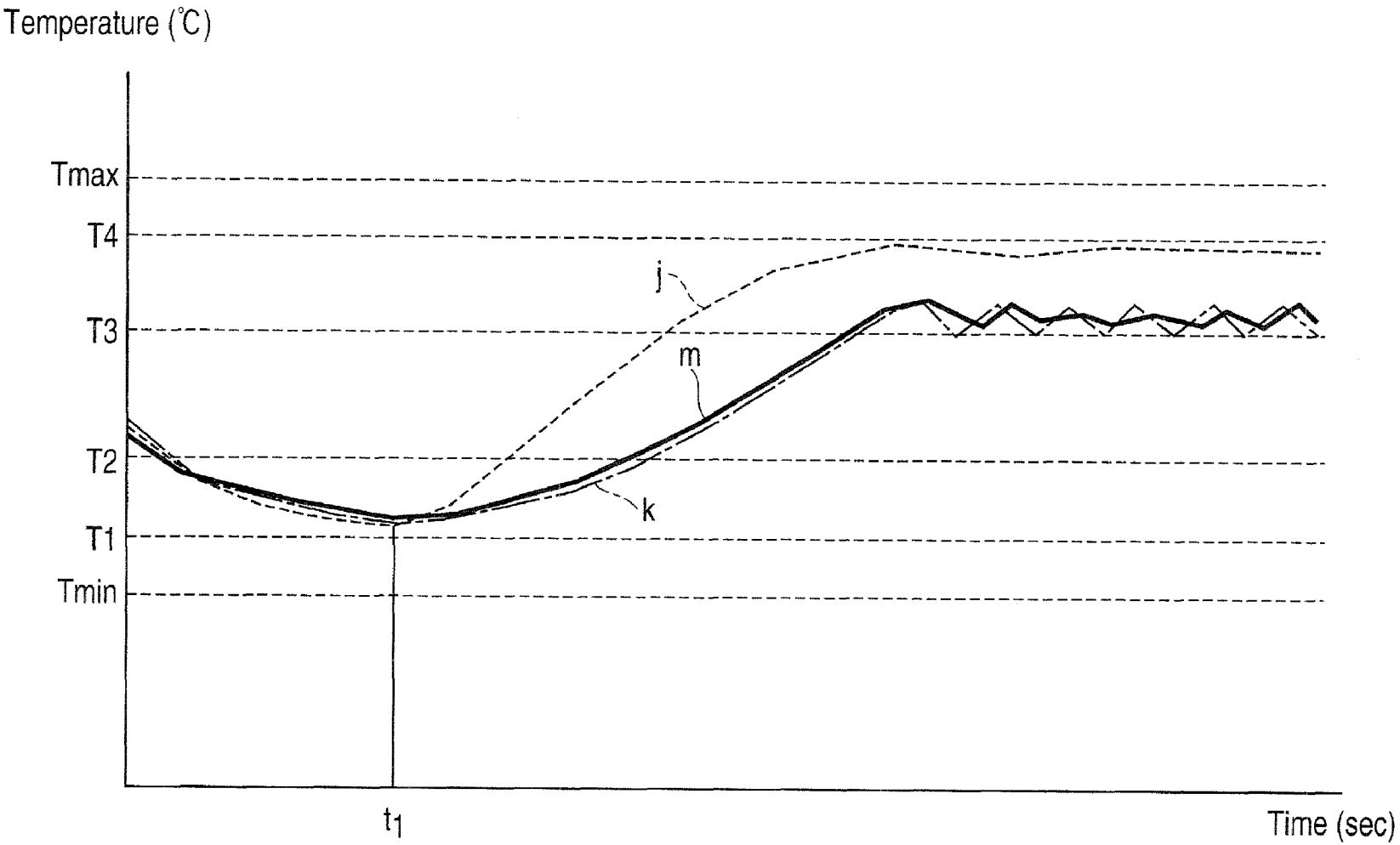
FIG. 17 shows comparison between the ink temperature during printing and output values from the recording heads.

In FIG. 17, the lowest output value from the temperature sensors 84 of the recording heads 20 is regarded as an ink temperature and is compared with the temperature measurement result by the referential temperature sensor 97 (see FIG. 15). The dotted line (curved line j) shown in FIG. 17 indicates the output value from the temperature sensor 84 having the highest printing rate. The double-dotted chained line (curved line k) indicates the output value from the referential temperature sensor 97. The solid line (curved line m) denotes the output value from the temperature sensor 84 having the lowest printing rate. FIG. 17 shows a case where a standby state is set at first, and a printing instruction is given at the time t1 before the ink temperature T reaches T1, for example.

In this case, as shown in FIG. 17, the output values from the temperature sensors in a standby mode are almost the same, and the ink temperature T gradually decreases. When a printing instruction is given at time t1, the temperatures of the recording heads 20 differ according to the difference in the amount of ink ejected from the recording heads 20, and the overall ink temperature T gradually rises due to the heat generated at the time of printing. Since the temperature control is not performed in the temperature range of T2-T3, the ink temperature T keeps on rising.

When the minimum temperature detected by the temperature sensors 84 has become more than T3, cooling control by the Peltier device 64 is performed, and the temperature rise of the recording heads 20 is stopped. The minimum value detected by the temperature sensors 84 of the recording heads 20 is detected by the temperature sensor 84 of the recording head with the lowest printing rate shown by the solid line. This minimum value is almost the same as the ink temperature measured for reference purpose and shown in the double-dotted chained line in FIG. 17. Therefore, when the output value (curved line j) from the temperature sensor 84 with the highest printing rate is used for ink temperature control, since the detected temperature becomes higher than the actual ink temperature, the ink temperature will be controlled to be lower than a desired temperature.

Figure 18:
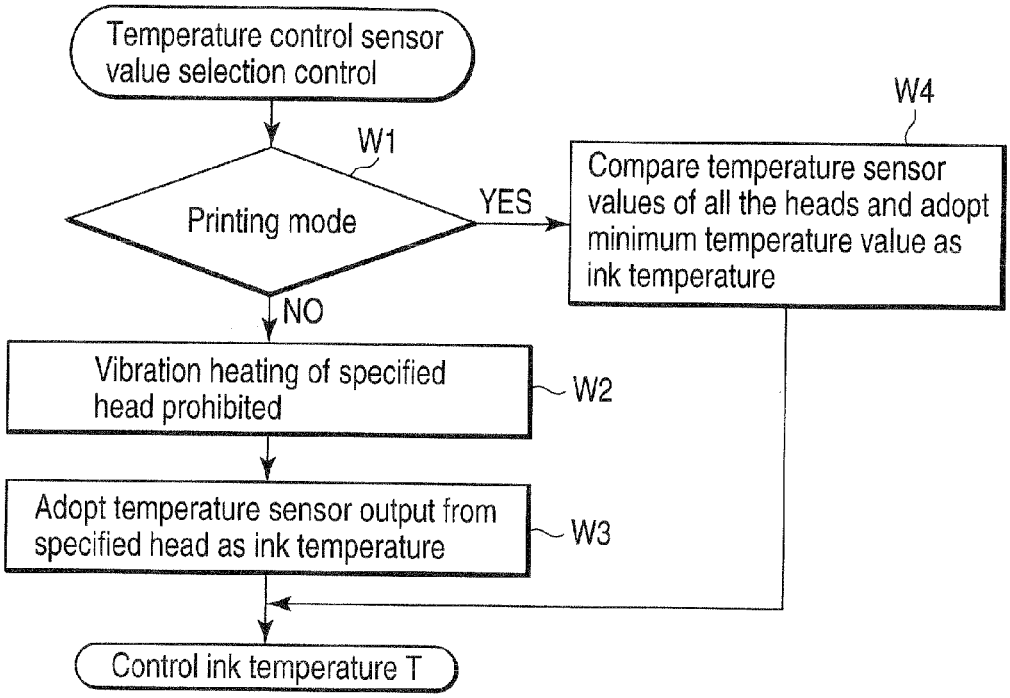
FIG. 18 is a flowchart illustrating the procedure for selecting a sensor for controlling the ink temperature from a plurality of temperature sensors.

The flowchart shown in FIG. 18 illustrates the procedure for selecting an ink temperature control sensor from the temperature sensors 84 based on the above-described analysis. The procedure starts with determination as to whether the image recording device 1 is in a printing mode or not (step (hereinafter abbreviated as W) 1). If the image recording device 1 is in a standby mode (NO in W1), vibration heating of a specified recording head 20 is prohibited (W2), and the output value from the temperature sensor 84 of the specified recording head 20 is adopted as the ink temperature T (W3).

When the image recording device 1 is in a printing mode (YES in W1), on the other hand, the output values from the temperature sensors 84 of all the recording heads are compared, and the minimum temperature value is adopted as the ink temperature (W4). As described above, when the temperature of the circulating ink is controlled, the ink is heated by adding a non-ejection waveform to the recording head to vibrate and heat the recording head. Further, by making some of the recording heads not to be driven and using them as temperature measurement heads which do not rise in temperature by being driven, measuring the ink temperature T by means of the temperature sensor 84 of that recording head, and controlling the temperature of the circulating ink based on the measured result, precise ink temperature setting can be performed without causing errors in the temperature sensors 84 due to the heat generated by the recording heads themselves.

Further, when the temperature of the circulating ink is controlled in a printing mode, by comparing the output values from the temperature sensors 84 of all the recording heads, selecting the recording head which outputs the minimum temperature value as a temperature measurement head, and controlling the temperature of the circulating ink based on the measured result, the errors of the temperature sensors 84 caused by the heat generated by the recording heads themselves can be eliminated, and thereby precise ink temperature setting can be performed. Selection of the temperature measurement head can be performed at a timing such as when the printing is started, when the printing job is changed, and when a predetermined time has elapsed.

Figure 19:
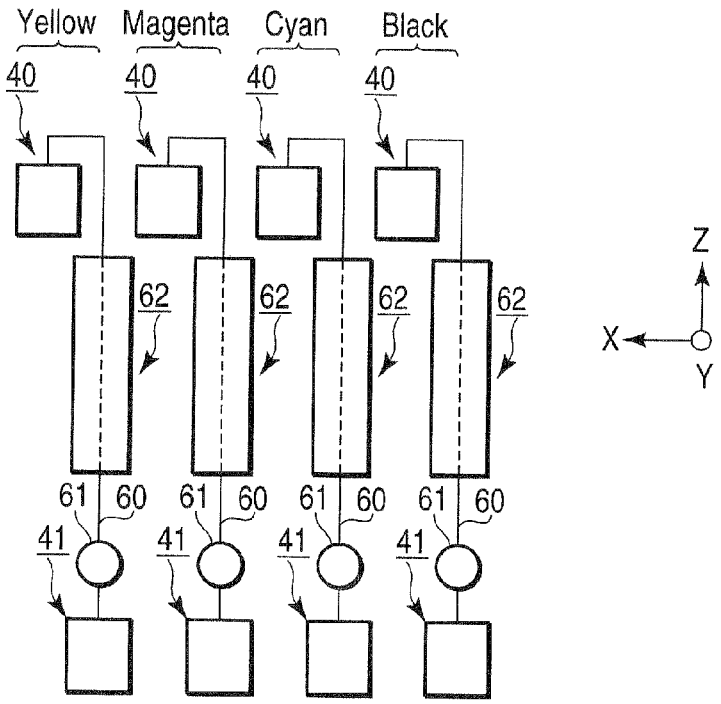
FIG. 19 schematically shows ink paths of the respective colors.

Next, the selection operation of the temperature sensor for ink temperature control at the time of color printing will be described. FIG. 19 schematically shows the ink path of each color. A separate heat exchanger 62 is provided in each ink path 60 of each color from the downstream subtank 41 to the upstream subtank 40. Each of the heat exchangers 62 is provided with the Peltier device 64 and the fan 65.

Figure 20:
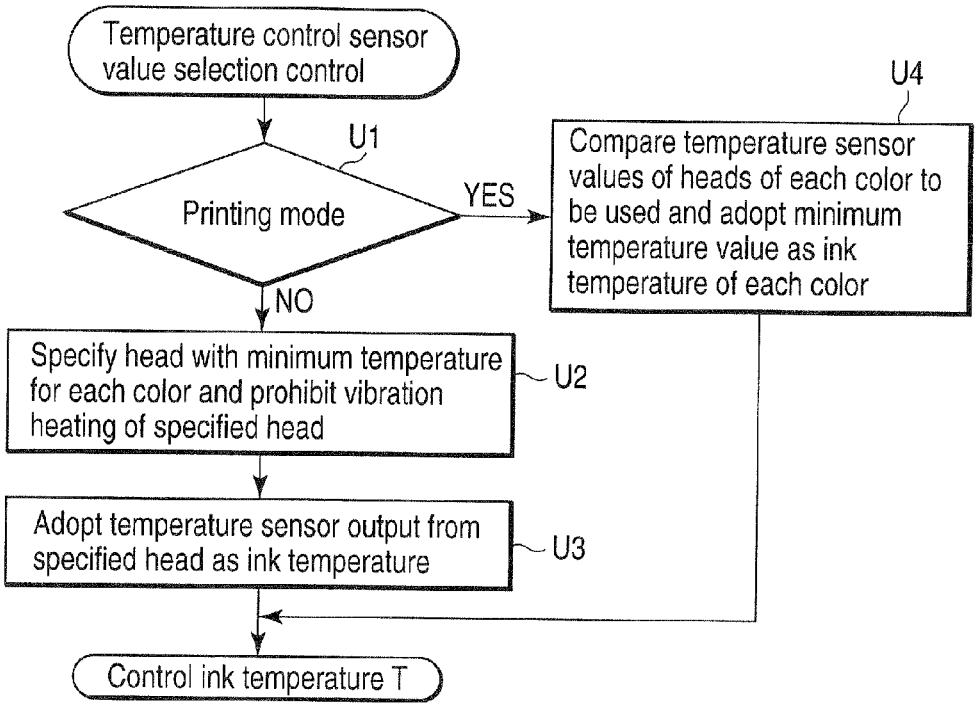
FIG. 20 is a flowchart illustrating the operation of selecting which temperature sensor to use.

In this case, control is performed according to the flowchart shown in FIG. 20 and one of the temperature sensors 84 is selected to be used. First, the control procedure starts with determination as to whether the image recording device 1 is in a printing mode or not (step (hereinafter abbreviated as U) 1).

When the image recording device 1 is in a standby mode (NO in U1), the recording head 20 indicating the minimum temperature value among the temperature sensors 84 of the six recording heads 20 of one color is specified as a non-driven temperature measurement head which is not vibrated or heated, since there may be a case where the recording head 20 itself which has just been used for the printing operation is not heated, and the value of the temperature sensor of the specified recording head 20 is adopted as the ink temperature of that color (U2, U3). In this case, since one of the six recording heads 20*a*-20*f* is not vibrated and heated, the amount of heat decreases to some degree, but precise ink temperature measurement can be performed with respect to each color.

When the image recording device 1 is in a printing mode (YES in U1), on the other hand, the values of the temperature sensors of the six recording heads 20*a*-20*f* are compared with respect to each color to be used, and the minimum temperature value at that time is adopted as the ink temperature of that color (U4).

The case where only one heat exchanger 62 is provided in the ink paths of four colors will be described below.

Figure 21:
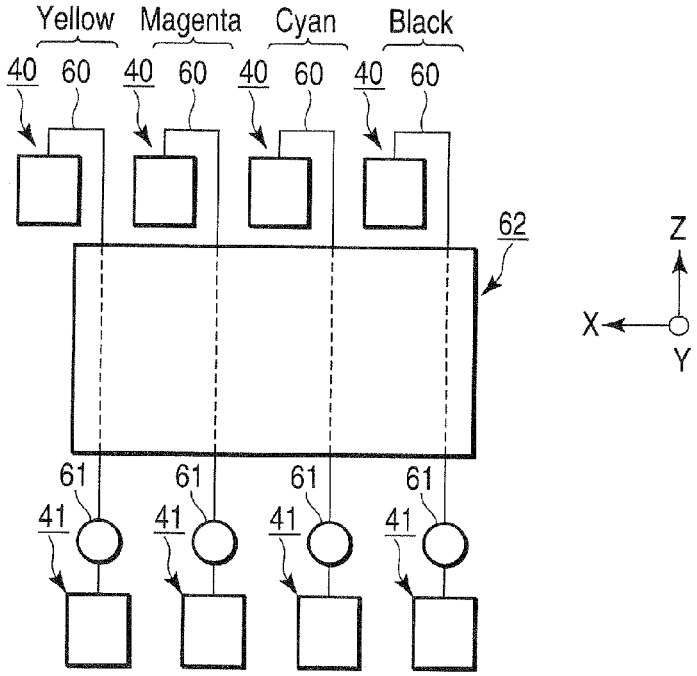
FIG. 21 illustrates a configuration in a case where only one heat converter exists in ink paths of four colors.

FIG. 21 illustrates such an example and all the ink paths 60 pass through the common heat exchanger 62. The heat exchanger 62 is provided with only one Peltier device 64. In this case, only some of the colors are used for the recording operation, and when the ink of such colors receives heat from the recording heads 20, the heat is transferred by the heat exchanger 62 and the ink temperature T is equalized, and thereby the ink of the four colors have the same temperature. Therefore, the ink temperature detection needs to be performed with respect to only one of the colors. In the present embodiment, 24 recording heads are used, as shown in FIG. 4, and one of the recording heads 20 (for example, the recording head 20*h* shown in FIG. 4) is specified for temperature measurement and is controlled such that the second waveform is not input thereto.

Figure 22:
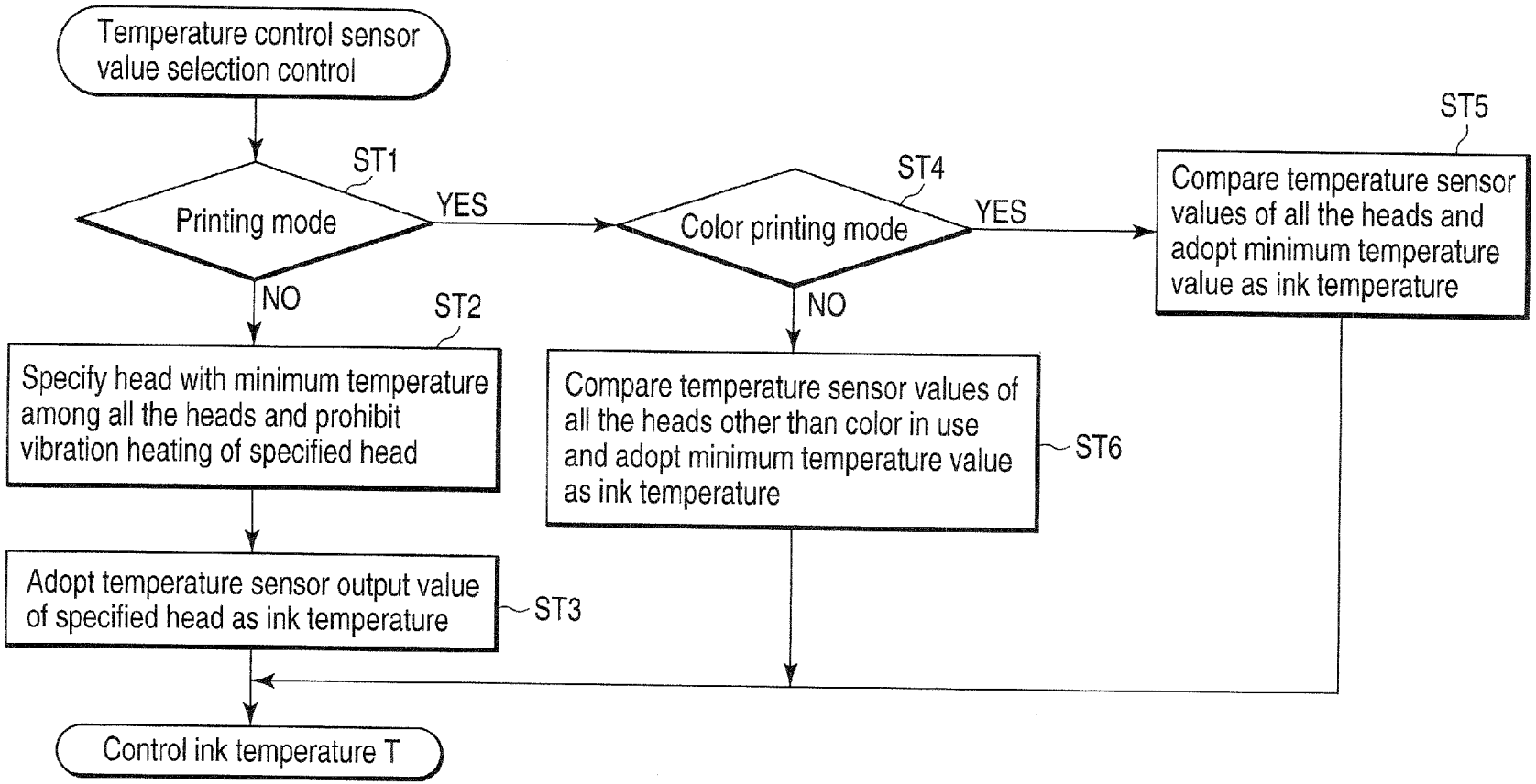
FIG. 22 is a flowchart illustrating the procedure for selecting which temperature sensor to use.

The flowchart shown in FIG. 22 illustrates the procedure of this example. The procedure starts with determination as to whether the image recording device 1 is in a printing mode or not (step (hereinafter abbreviated as ST) 1). When the image recording device 1 is in a standby mode (NO in ST1), one of the 24 recording heads can be specified. There is the possibility, however, that the recording head 20 is heated by the previous printing mode, and therefore the recording head with the lowest temperature at that time is specified. The specified recording head 20 is not vibrated or heated and driving of the Peltier device 64 is controlled based on the temperature sensor value of the recording head 20 (ST2, ST3).

As a result, the amount of heat used for vibration and heating decreases to 23/24, but the difference is slight. By tolerating the difference, the necessity to add a new temperature sensor in the ink path is eliminated, and precise temperature control can be performed using the temperature sensor 84 of the recording head 20.

When the image recording device 1 is in a printing mode (YES in ST1), on the other hand, it is determined whether the printing mode is a color printing mode (ST4). When the printing mode is a color printing mode (YES in ST4), ink is ejected to all the recording heads 20 of the four colors. In this case, the values of the temperature sensors of all the recording heads 20 are compared, and the minimum temperature value is adopted as the ink temperature (ST5). When the printing mode is a monochrome mode (NO in ST4), in which only black, for example, is used, the temperature values of the recording heads of the other three colors having no possibility of emitting heat due to ejection are compared, and the minimum temperature value is adopted as the ink temperature (ST6).

As described above, according to the present embodiment, by comparing the values of the temperature sensors 84 installed in the recording heads and calculating the ink temperature based on the comparison result, the temperature can be controlled based on the temperature sensor value of the recording head 20 which emits a small amount of heat. Thereby, the necessity to add a new sensor 84 in the ink path, for example, is eliminated.

Figure 23:
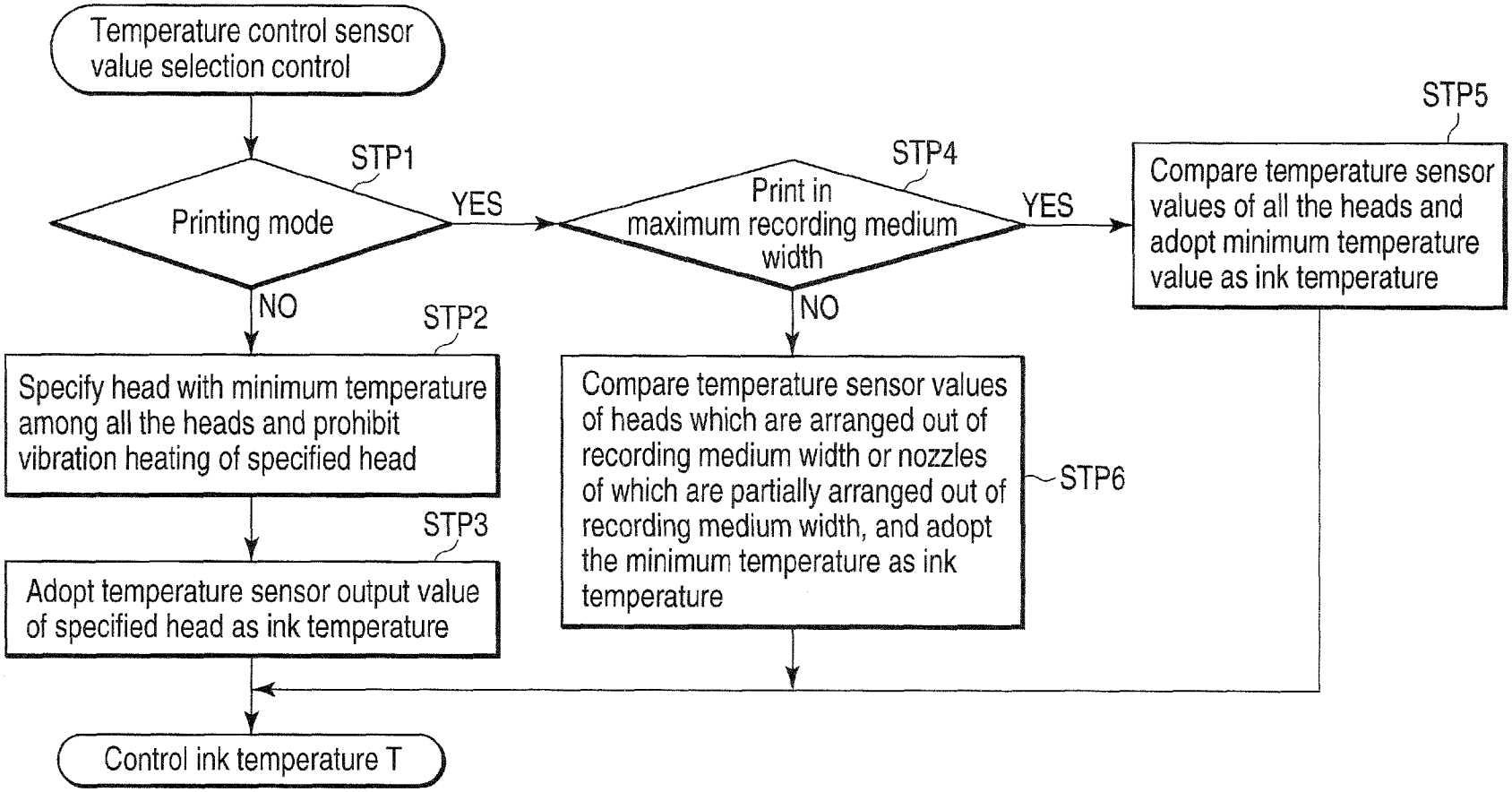
FIG. 23 is a flowchart illustrating the case where the temperature sensor is selected according to the width of a recording medium.

Next, the case where a temperature sensor is selected according to the width of the recording medium will be described below. FIG. 23 is a flowchart illustrating the procedure. In this case, it is determined whether the image recording device 1 is in a printing mode or not (step (hereinafter abbreviated as STP) 1). When the image recording device 1 is in a standby mode (NO in STP1), the same operation as that of FIG. 22 is performed, and driving of the Peltier device 64 is controlled based on the temperature sensor value of the recording head 20 which has been specified from among 24 recording heads and is not vibrated or heated (STP2, STP3).

When the image recording device 1 is in a printing mode (YES in STP1), it is determined whether the recording medium to be used has the maximum width (STP4). When the recording medium to be used has the maximum width (YES in STP4), since there is the possibility that all the recording heads 20 are involved in printing, the temperature sensor values of all the recording heads 20 are compared, and the minimum temperature value is adopted as the ink temperature (STP5).

When the recording medium does not have the maximum recording medium width (NO in STP4), the recording head 20 arranged outside the recording medium width is not involved in recording, and does not have the possibility to emit heat. Therefore, the temperature values of the recording heads outside the recording medium width are compared, and the minimum temperature value is adopted as the ink temperature (STP6).

In this case, when vibration and heating is performed using the recording head 20 outside the recording medium width, the temperature sensor value of the recording head 20 can be used instead of performing vibration and heating using the recording head with the lowest temperature at that time.

Depending on the size of the recording medium, there may not be a recording head outside the recording medium width, but there may be a recoding medium in which a part of the nozzle is opposed to the recording medium with respect to the recording medium width, and the other part is outside the recording medium width. In this case, the recording mediums in which all the nozzles are contained within the recording medium width are eliminated from the selection alternatives, and all the recording heads 20 in which only a part of the nozzles extend over the recording medium width become the alternatives. As a result of comparison of the temperature values of such recording heads, the minimum temperature value is adopted as the ink temperature.

As described above, according to the present embodiment, when a printing medium with a small width is used in a printing mode, by specifying the recording heads outside the recording medium in advance, and performing the ink temperature control using the output values of the temperature sensors provided in the recording heads, precise ink temperature detection can be performed, since the recording heads which rise in temperature due to ejection have been eliminated in advance.

If the outer temperature of the surrounding area of the image recording device 1 is high and the temperature value obtained from the temperature sensor 84 even after cooling control by the Peltier device 64 is higher than Tmax, the printing prohibition control is performed. In this case, based on the highest temperature from among the values of the temperature sensors 84, the printing prohibition control is performed. By thus performing the control, it is possible to prevent in advance the problem that some of the recording heads deviate from the preferable printable range and the image quality deteriorates.

In the present embodiment, in order to eliminate the waiting time caused by temperature control until the start of printing, T1 is set such that the relationship of Tmin<T1 is satisfied, and T4 is set such that the relationship of T4<Tmax is satisfied. In a case where a waiting time can be tolerated to some degree, T1 and T4 can be set such that the following equations are satisfied: T1=Tmin and T4=Tmax.

In the present embodiment, the ink temperature is constantly monitored in the standby mode, and after the set temperature is reached, the circulation operation and the temperature control is restarted. However, in a case where the ink is not circulating, the ink temperature may differ slightly according to the place. When circulation starts, the output values of the temperature sensors may change. In such a condition, instead of simultaneously starting the ink circulation and the temperature control, the circulation may be started first and the temperature may be detected again after a predetermined time has elapsed, and by comparing the detected temperature with the temperature which has been set based on the result, and whether to perform the temperature control or not may be determined.

In the present embodiment, the ink temperature is constantly monitored in a standby state, and when the set temperature is reached, the circulation operation and the temperature control are restarted. However, the circulation control may be performed in predetermined cycles in a standby state, and whether to perform the temperature control may be determined based on the values of the temperature detection sensor at that time.

Moreover, in the present embodiment, when a temperature sensor is selected in a printing mode, the output value from the sensor with the lowest temperature from among the temperature sensors mounted on the recording heads is regarded as the ink temperature to be controlled. However, there may be a rare case where a value of a sensor includes an abnormal value and performs error detection.

In order to eliminate such error detection, by providing a plurality of temperature measurement heads, and selecting a group of output values indicating low temperatures and taking an average thereof, the average value may be regarded as the ink temperature. A more preferable method is to perform an operation to remove an abnormal value based on calculation of the group of the output values and regard the calculated result as the ink temperature. Various calculation methods are publicly known as methods of removing an abnormal value. For example, the method of selecting four detection values with the lowest temperatures and adopting the average value of three values other than the lowest value as a result, or adopting the second lowest value may be adopted.

In the above-described embodiment, the circulating ink paths and the circulation methods are not limited to those described in the embodiment. The temperature sensor for ink temperature measurement may be arranged in ink paths or ink tanks as well as in the heads.

The configuration of the group of heads is not limited to the heads of four colors each formed of six heads, and any group of heads formed of a plurality of heads may be used.

According to the present embodiment, a temperature measurement head is selected from a plurality of heads based on the temperature of the heads, the ink temperature is measured based on the temperature sensor provided in the selected head, and the temperature control of the circulating ink is performed based on the measured result. Thereby, errors in temperature sensors caused by heat generated by the heads themselves can be decreased, and precise ink temperature control can be performed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image recording device comprising:

a head group formed of a plurality of heads which eject ink drops from a plurality of nozzle holes;

a tank configured to store ink which is supplied to the heads;

an ink path which connects the tank with the heads and in which the ink is circulated by a circulation driving means;

a temperature sensor provided in each of the heads;

a head driving means which applied to a driving waveform to eject ink drops to the heads; and a control means which controlled the circulation driving means and the head driving means, wherein the control means selects at least one of the heads as a temperature measurement head, and controls a temperature of the ink based on an output value from a corresponding one of the temperature sensors which is provided in the temperature measurement head, the number of the temperature measurement heads being smaller than the number of heads forming the head group.

2. The image recording device according to claim 1, wherein the head driving means applies the driving waveform to all of the heads except for the temperature measurement heads.

3. The image recording device according to claim 1, wherein the number of colors of the ink is more than one, the ink path and the head group are provided for each of the colors, and the head group of each of the colors has at least one of the temperature measurement heads.

4. The image recording device according to claim 1, wherein the number of colors of the ink is more than one, the ink path and the head group are provided for each of the colors, the image recording device further comprises a heat exchange member common to the ink paths of the respective colors, the control means selects at least one of the temperature measurement heads from the head groups of the respective colors, and controls the heat exchange member based on an output from a corresponding one of the temperature sensors of each of the temperature measurement heads which have been selected for each color.

5. An image recording device according to claim 1, wherein the ink path includes a heat adjustment member which cools or heats the ink, and the control means controls the temperature adjustment member based on output from the temperature sensor.

6. The image recording device according to claim 1, wherein a head having the lowest temperature is selected as the temperature measurement head from among the plurality of heads.

7. The image recording device according to claim 1, comprising:

a first temperature range which has a maximum temperature and a minimum temperature and in which the heads can preferably eject ink; and a second temperature range which is the same as or included in the first temperature range and has a target temperature at which the temperature of the ink is controlled, wherein the control means controls the temperature of the ink within the second temperature range based on an output from the temperature sensor in a standby mode other than a printing mode in which a printing instruction is accepted.

8. The image recording device according to claim 7, wherein the control means starts driving of the circulation driving means to circulate the ink in the ink path and heats or cools the ink until output from the temperature sensor reaches the target temperature, upon detection of output from the temperature sensor which is out of the second temperature range in the standby mode.

9. The image recording device according to claim 1, comprising:

a first temperature range which has a maximum temperature and a minimum temperature and in which the heads can preferably eject ink; and a second temperature range which is the same as or included in the first temperature range and has a target temperature at which the ink temperature is controlled, wherein the control means controls the ink temperature within the first temperature range based on output from the temperature sensor in a printing mode in which a printing instruction is accepted.

10. The ink jet printer according to claim 7, wherein the control means selects a temperature from which the lowest temperature is detected from among output values from the plurality of temperature sensors as an ink temperature control temperature sensor both in a printing mode in which a printing instruction is accepted and in a standby mode other than the printing mode.

11. An ink jet printer comprising:

a head group formed of a plurality of heads which eject ink drops from a plurality of nozzles;

an ink tank which stores ink supplied to the plurality of heads of the head group;

an ink path which connects the ink tank with the plurality of heads of the head group and in which the ink is circulated by an ink circulation means;

a temperature sensor which is provided in each of the plurality of heads and detects a temperature of each of the heads;

a head driving means which apply a driving waveform to eject ink drops to each of the plurality of heads; and a control means which control the ink circulation driving means and the head driving means, wherein the control means selects a temperature sensor from which the lowest temperature is detected among output values of the plurality of temperature sensors as an ink temperature control temperature measurement sensor, and controls a temperature of the ink based on an output value from the ink temperature control temperature measurement head.

12. The ink jet printer according to claim 11, wherein the control means selects a temperature sensor from which the lowest temperature is detected as an ink temperature control temperature sensor from among output values from the plurality of temperature sensors in a printing mode in which a printing instruction is accepted, and selects a temperature sensor provided in a preset head as an ink temperature control sensor in a standby mode which is other than the printing mode.

13. The ink jet printer according to claim 11, wherein the head group, the ink tank, and the ink path are provided for the ink of each of a plurality of colors, and the control means selects an ink temperature control temperature sensor for the ink of each of the colors.

14. The ink jet printer according to claim 13, wherein the control means selects the ink temperature control temperature sensor from the temperature sensors provided in the heads of the ink colors other than a used color in a printing mode in which only a part of ink colors is used from a plurality of ink colors.

15. The ink jet printer according to claim 11, wherein the control means selects some of the plurality of temperature sensors from which low temperatures are detected as an ink temperature control temperature sensor group, and controls a temperature of the ink based on output values from the ink temperature control temperature sensor group.

16. The ink jet printer according to claim 11, wherein the control means selects the ink temperature control temperature sensor when printing is started or a printing job is changed.

17. An ink jet printer comprising:

a head group formed of a plurality of heads which eject ink drops from a plurality of nozzles;

an ink tank which stores ink supplied to the plurality of heads of the head group;

an ink path which connects the ink tank with the plurality of heads of the head group and in which the ink is circulated by an ink circulation means;

a temperature sensor which is provided in each of the plurality of heads and detects a temperature of each of the heads;

a head driving means which applies a driving waveform to eject ink drops to each of the plurality of heads; and a control means which control the ink circulation driving means and the head driving means, selecting one of the plurality of heads having the lowest possibility to be provided with the driving waveform by the head driving means as an ink temperature control head, and controlling a temperature of the ink based on an output value from a corresponding one of the temperature sensors which is provided in the ink temperature measurement head.

18. The ink jet printer according to claim 17, wherein one of the plurality of heads with the lowest printing rate is selected as an ink temperature control head.

19. The ink jet printer according to claim 17, wherein the control means sets a head arranged on either end of a direction of an image recording medium as an ink temperature control head from among a plurality of heads arranged in a width direction of the image recording medium.

20. An ink jet printer comprising:

a head group formed of a plurality of heads which eject ink drops from a plurality of nozzles;

an ink tank which stores ink supplied to the plurality of heads of the head group;

an ink path which connects the ink tank with the plurality of heads of the head group and in which the ink is circulated by an ink circulation means;

a temperature sensor which is provided in each of the plurality of heads and detects a temperature of each of the heads;

a head driving means which applies a driving waveform to eject ink drops to each of the plurality of heads; and a control means controls the ink circulation driving means and the head driving means, detects a size of the recording medium used for image recording, and sets some of the plurality of heads which are not opposed to or only partially opposed to the recording medium as ink temperature control heads.

21. An ink jet printer comprising:

a head group formed of a plurality of heads which eject ink drops from a plurality of nozzles;

an ink tank which stores ink supplied to the plurality of heads of the head group;

an ink path which connects the ink tank with the plurality of heads of the head group and in which the ink is circulated by an ink circulation means;

a temperature sensor which is provided in each of the plurality of heads and detects a temperature of each of the heads; and a control means which determine whether the ink jet printer is in a printing mode in which a printing instruction is accepted or in a standby mode which is other than the printing mode, wherein one of the temperature sensors from which the lowest temperature is detected from among output values from the plurality of temperature sensors is selected as an ink temperature control temperature sensor in a printing mode, and a temperature sensor provided in a preset head is selected as an ink temperature control sensor and applies a driving waveform of an extent that does not eject ink to the heads other than the head in which the ink temperature control sensor is provided in a waiting mode.

* * * * *